US012662761B2

(12) United States Patent
Kim et al.

(10) Patent No.: US 12,662,761 B2
(45) Date of Patent: Jun. 23, 2026

(54) CLOTHES TREATING SYSTEM

(71) Applicant: SAMSUNG ELECTRONICS CO., LTD., Suwon-si (KR)

(72) Inventors: Bokyun Kim, Suwon-si (KR); Jonghun Sung, Suwon-si (KR); Yoonseob Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 130 days.

(21) Appl. No.: 18/382,709

(22) Filed: Oct. 23, 2023

(65) Prior Publication Data

US 2024/0167210 A1 May 23, 2024

Related U.S. Application Data

(63) Continuation of application No. PCT/KR2023/013357, filed on Sep. 6, 2023.

(30) Foreign Application Priority Data

Nov. 22, 2022 (KR) ..... 10-2022-0157704
Jan. 26, 2023 (KR) ..... 10-2023-0010321

(51) Int. Cl.
*D06F 29/00* (2006.01)
*D06F 39/12* (2006.01)
*D06F 58/20* (2006.01)

(52) U.S. Cl.
CPC ..... *D06F 29/005* (2013.01); *D06F 39/125* (2013.01); *D06F 58/20* (2013.01)

(58) Field of Classification Search
CPC ..... D06F 29/005; D06F 39/00; D06F 39/125; D06F 58/20

(Continued)

(56) References Cited

U.S. PATENT DOCUMENTS 6,029,940 A * 2/2000 Klein ..... H05K 5/0204 248/500
8,540,326 B2 * 9/2013 Moszer ..... A47B 67/04 248/501

(Continued)

FOREIGN PATENT DOCUMENTS

CN 113279197 A 8/2021
CN 215628882 U 1/2022

(Continued)

OTHER PUBLICATIONS

International Search Report dated Dec. 26, 2023 issued in PCT Application No. PCT/KR2023/013357.

(Continued)

*Primary Examiner* — James O Hansen
(74) *Attorney, Agent, or Firm* — STAAS & HALSEY LLP

(57) ABSTRACT

A clothes treating system including a first clothes treating apparatus including a first housing, and the first housing including a sliding guide portion on an upper surface of the first housing, and a leg seating portion at an end of the sliding guide portion; and a second clothes treating apparatus including a second housing, and the second housing including a leg on a rear side of a lower surface of the second housing. The first clothes treating apparatus and the second clothes treating apparatus are configured so that the leg is slidable along the sliding guide portion to seat the leg on the leg seating portion with a lower surface of the leg being below the upper surface of the first housing, to couple the second clothes treating apparatus to the first clothes treating apparatus with the second clothes treating apparatus above the first clothes treating apparatus.

18 Claims, 21 Drawing Sheets

(58) Field of Classification Search
USPC ..... 312/198, 228
See application file for complete search history.

(56) References Cited

U.S. PATENT DOCUMENTS

| | | | | |
|---|---|---|---|---|
| 12,305,319 | B2 | 5/2025 | Kwon et al. | |
| 2005/0139738 | A1* | 6/2005 | Hwang | D06F 39/125 248/300 |
| 2005/0275325 | A1* | 12/2005 | Yang | D06F 29/005 312/330.1 |
| 2006/0010934 | A1 | 1/2006 | Kim | |
| 2011/0241501 | A1* | 10/2011 | Heo | D06F 29/005 312/107 |
| 2021/0017692 | A1* | 1/2021 | James | D06F 39/125 |
| 2021/0214879 | A1* | 7/2021 | Lee | D06F 39/125 |

FOREIGN PATENT DOCUMENTS

| | | |
|---|---|---|
| EP | 1 550 756 A1 | 7/2005 |
| EP | 3 670 727 A1 | 6/2020 |
| KR | 10-2004-0081297 | 9/2004 |
| KR | 10-2004-0085515 | 10/2004 |
| KR | 10-2004-0085520 | 10/2004 |
| KR | 10-2006-0005849 | 1/2006 |
| KR | 10-2008-0040382 | 5/2008 |
| KR | 10-2009-0116106 | 11/2009 |
| KR | 10-2009-0127763 | 12/2009 |
| KR | 10-2010-0001436 | 1/2010 |
| KR | 10-2010-0001437 | 1/2010 |
| KR | 10-2010-0001438 | 1/2010 |
| KR | 10-2013-0027926 | 3/2013 |
| KR | 20-0489767 | 8/2019 |
| KR | 10-2021-0108862 | 9/2021 |

OTHER PUBLICATIONS

Written Opinion dated Dec. 26, 2023 issued in PCT Application No. PCT/KR2023/013357.

Office Action dated Aug. 22, 2025, in European Application No. EP 23 89 4753.

* cited by examiner

CLOTHES TREATING SYSTEM

CROSS-REFERENCE TO RELATED APPLICATIONS

This is a continuation application of International Application PCT/KR2023/013357, filed Sep. 6, 2023, which is incorporated herein by reference in its entirety, it being further noted that foreign priority benefit is based upon Korean Patent Application Nos. 10-2022-0157704, filed Nov. 22, 2022, and 10-2023-0010321, filed Jan. 26, 2023, the disclosures of which are incorporated by reference herein in their entireties.

BACKGROUND

1. Field

The present disclosure relates to a clothes treating system including at least one clothes treating apparatus.

2. Description of Related Art

A clothes treating apparatus is an apparatus for treating and/or managing clothes. The clothes treating apparatus may include a washing machine and a dryer.

A washing machine is an apparatus that performs washing through friction between laundry, water, and detergent put into a tub by stirring the laundry, water, and detergent together using a driving force of a driving motor. A procedure to be performed by the washing machine may include a washing process of supplying detergent and water to the tub accommodating laundry and washing the laundry while rotating a drum, a rinsing process of supplying water to the tub and rotating the drum to rinse the laundry, and a dewatering process of discharging the water from the tub and rotating the drum to remove moisture from the laundry, regardless of the type of washing machine.

A dryer is an apparatus that dries an object with high-temperature dry air. The dryer dries an object by allowing hot air to pass through a drum while rotating the drum in which the object is accommodated at low speed. A procedure to be performed by the dryer may include a drying process of drying an object.

For convenience of use, a plurality of clothes treating apparatuses may be connected and used.

SUMMARY

According to an embodiment, a clothes treating system may include a first clothes treating apparatus including a first housing, and the first housing including a sliding guide portion on an upper surface of the first housing, and a leg seating portion at an end of the sliding guide portion; and a second clothes treating apparatus including a second housing, and the second housing including a leg on a rear side of a lower surface of the second housing, wherein the first clothes treating apparatus and the second clothes treating apparatus are configured so that the leg is slidable along the sliding guide portion to seat the leg on the leg seating portion with a lower surface of the leg being below the upper surface of the first housing, to couple the second clothes treating apparatus to the first clothes treating apparatus with the second clothes treating apparatus above the first clothes treating apparatus.

According to an embodiment, at least a portion of the upper surface of the first housing may be recessed downward to thereby form the sliding guide portion.

According to an embodiment, the sliding guide portion may extend from a first end of the sliding guide portion that is adjacent to a front end of the upper surface of the first housing to a second end of the sliding guide portion that is adjacent to a rear end of the upper surface of the first housing.

According to an embodiment, the sliding guide portion may include regions having depths that are recessed downward from the upper surface of the first housing and gradually deepen toward the second end of the sliding guide portion from the first end of the sliding guide portion.

According to an embodiment, the leg seating portion may be on a rear side of the second end of the sliding guide portion, and the first clothes treating apparatus and the second clothes treating apparatus may be configured so that the leg is slidable from the first end of the sliding guide portion to the second end of the sliding guide portion to be seated on the leg seating portion.

According to an embodiment, the leg seating portion may include a protruding portion connected to the second end of the sliding guide portion and protruding upward more than the second end of the sliding guide portion, a seating part on a rear side of the protruding portion and on which the leg becomes seated when the leg is seated on the leg seating portion, and a stopper configured to prevent the leg seated on the seating part from moving to a rear of the seating part.

According to an embodiment, the leg seating portion may be configured so that, when the leg is seated on the leg seating portion, the leg is fixedly seated on the seating part as one side of the leg is supported by the protruding portion and an other side of the leg is supported by the stopper.

According to an embodiment, the second housing may include a contact part along at least a portion of an edge of the lower surface of the second housing and configured to come into contact with the upper surface of the first housing when the second clothes treating apparatus is coupled to the first clothes treating apparatus, and the first housing may include a supporting part along at least a portion of an edge of the upper surface of the first housing and configured to support the contact part of the second housing when the second clothes treating apparatus is coupled to the first clothes treating apparatus.

According to an embodiment, the contact part may include a first contact part adjacent to the edge of the lower surface of the second housing, a second contact part spaced further from the edge of the lower surface than the first contact part, and a third contact part spaced further from the edge of the lower surface than the second contact part and protruding downward more than the first contact part and the second contact part.

According to an embodiment, the supporting part may include a first supporting part adjacent to the edge of the upper surface of the first housing and configured to support the first contact part and the second contact part when the second clothes treating apparatus is coupled to the first clothes treating apparatus, and a second supporting part spaced further from the edge of the upper surface than the first supporting part, recessed downward more than the first supporting part, and configured to support the third contact part when the second clothes treating apparatus is coupled to the first clothes treating apparatus.

According to an embodiment, a side surface of the first housing may be disposed below the supporting part to support a load of the second clothes treating apparatus transferred through the contact part and the supporting part when the second clothes treating apparatus is coupled to the first clothes treating apparatus.

According to an embodiment, the upper surface of the first housing may include a cover plate that includes the sliding guide portion, and a plate supporting member that includes the leg seating portion and is configured to support at least a portion of an edge of the cover plate.

According to an embodiment, the first clothes treating apparatus and the second clothes treating apparatus may be configured so that the second clothes treating apparatus is couplable to the first clothes treating apparatus by being positioned on the first clothes treating apparatus and then sliding backward from a front of the first clothes treating apparatus.

According to an embodiment, the second clothes treating apparatus may include an additional leg on a front side of the lower surface of the second housing and configured so that, when the second clothes treating apparatus is not coupled to the first clothes treating apparatus, the second clothes treating apparatus stands on its own.

According to an embodiment, when the second clothes treating apparatus is coupled to the first clothes treating apparatus, the additional leg may be separated from the lower surface of the second housing.

DETAILED DESCRIPTION

Figure 1:
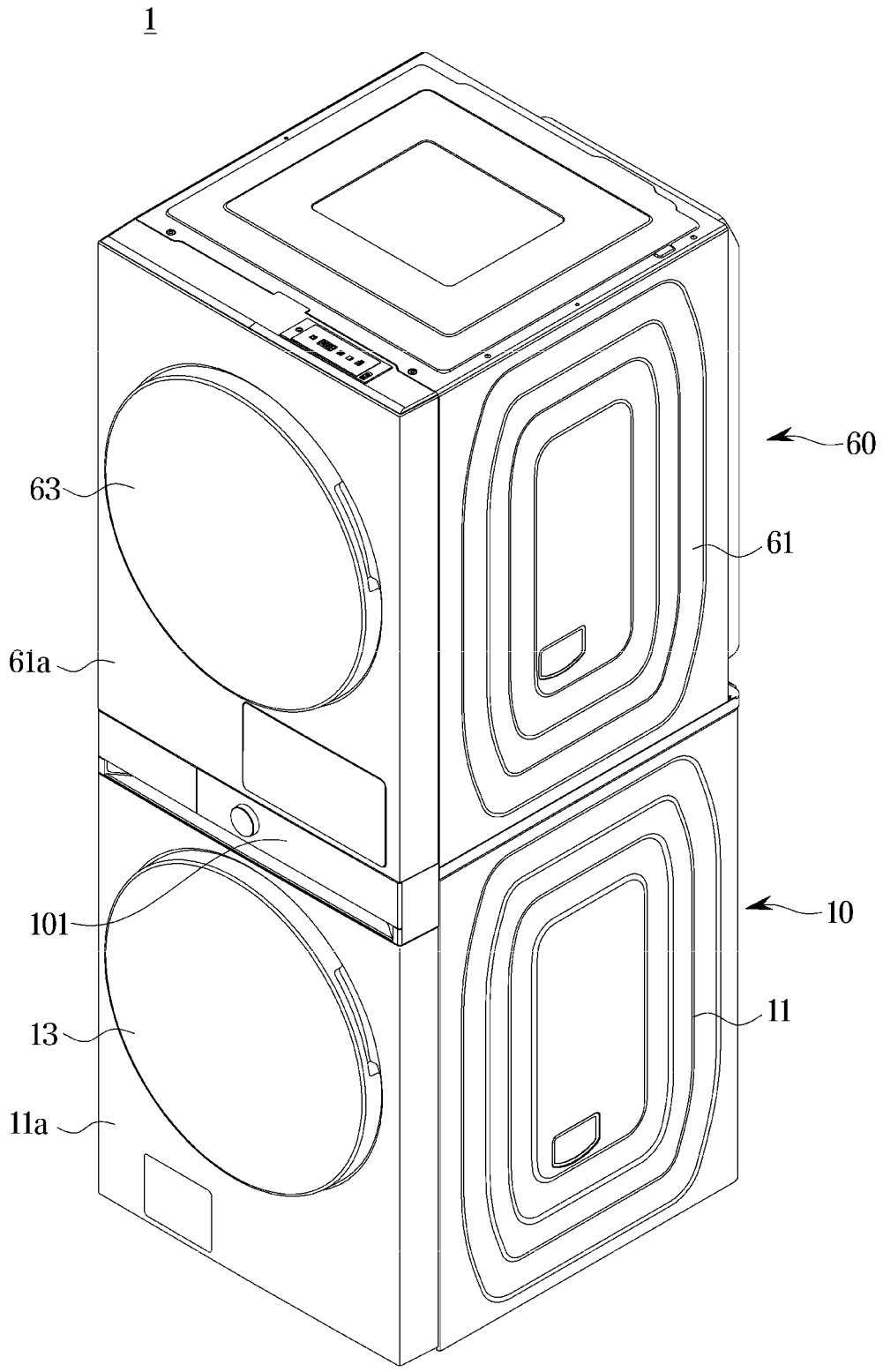
FIG. 1 illustrates a clothes treating system according to an embodiment.

Various embodiments and terms in this document are not intended to limit the technical features described in this document to specific embodiments, and should be understood to include various modifications, equivalents, or substitutes of the embodiments.

In connection with the description of the drawings, like reference numbers may be used for like or related elements.

The singular form of a noun corresponding to an item may include one item or a plurality of items, unless the relevant context clearly dictates otherwise.

In this document, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other respect (e.g., importance or order).

When any (e.g., first) component is referred to as being "coupled" or "connected" to another (e.g., second) component with or without the terms "functionally" or "communicatively", this means that the any component may be connected to the other component directly (e.g., by a wire), wirelessly, or through a third component.

The terms "comprises" and "has" are intended to indicate that there are features, numbers, steps, operations, components, parts, or combinations thereof described in this document, and do not exclude the presence or addition of one or more other features, numbers, steps, operations, components, parts, or combinations thereof.

When any component is referred to as being "connected", "coupled", "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

A washing machine according to various embodiments may perform washing, rinsing, dewatering, and drying processes. A washing machine is an example of a clothes treating apparatus, and the clothes treating apparatus is a concept encompassing an apparatus for washing clothes (objects to be washed, objects to be dried), an apparatus for drying clothes, and an apparatus capable of washing and drying clothes.

A washing machine according to various embodiments may include a top-loading washing machine in which a laundry inlet for putting in or taking out laundry is provided to face upward or a front-loading washing machine in which a laundry inlet is provided to face forward. A washing machine according to various embodiments may include a washing machine of another loading method other than a top-loading washing machine and a front-loading washing machine.

In the case of a top-loading washing machine, laundry may be washed using a water current occurred by a rotating body such as a pulsator. In the case of a front-loading washing machine, laundry may be washed by rotating a drum to repeatedly raise and drop laundry. The front-loading washing machine may include a drying coupled washing machine capable of drying laundry accommodated inside a drum.

The drying coupled washing machine may include a hot air supply device for supplying high-temperature air into the drum and a condensing device for removing moisture from air discharged from the drum. For example, the drying coupled washing machine may include a heat pump device. A washing machine according to various embodiments may include a washing machine using a washing method other than the above-described washing method.

Various embodiments are directed to providing a clothes treating system in which a first clothes treating apparatus and a second clothes treating apparatus are easily coupled by reducing the number of parts and the number of processes required when the first clothes treating apparatus and the second clothes treating apparatus are coupled.

Various embodiments are directed to providing a clothes treating system having improved space utilization and usability of a second clothes treating apparatus by reducing a height of the clothes treating system.

Various embodiments are directed to providing a clothes treating system having improved installability by allowing a second clothes treating apparatus to be coupled with a first clothes treating apparatus from the front of the first clothes treating apparatus.

Technical tasks to be achieved in the present disclosure are not limited to technical tasks mentioned above, and other technical tasks not mentioned will be clearly understood by those skilled in the art from the description below. Hereinafter, a clothes treating system according to various embodiments will be described in detail with reference to the accompanying drawings.

Figure 2:
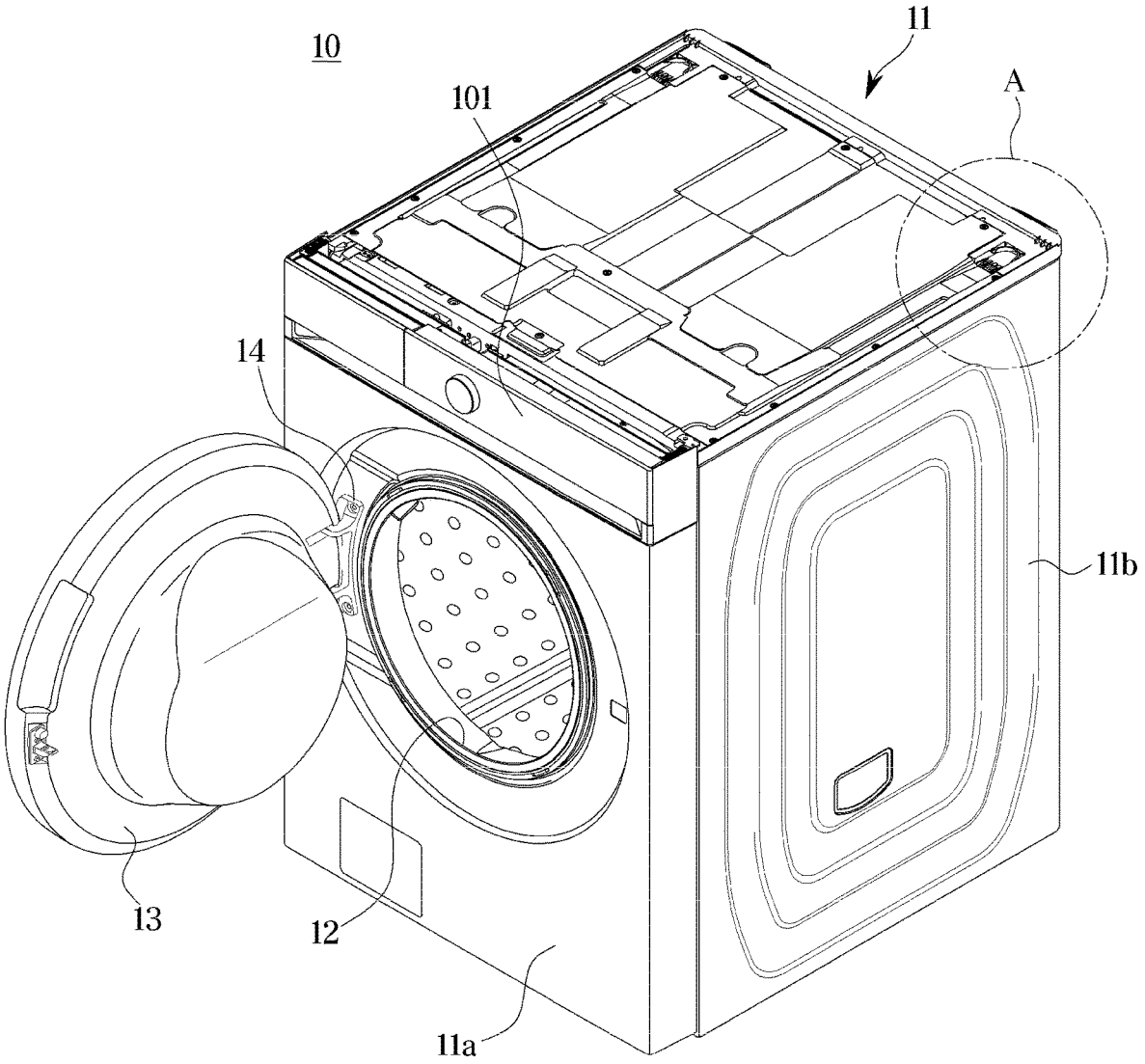
FIG. 2 illustrates a first clothes treating apparatus of the clothes treating system according to an embodiment.
Figure 3:
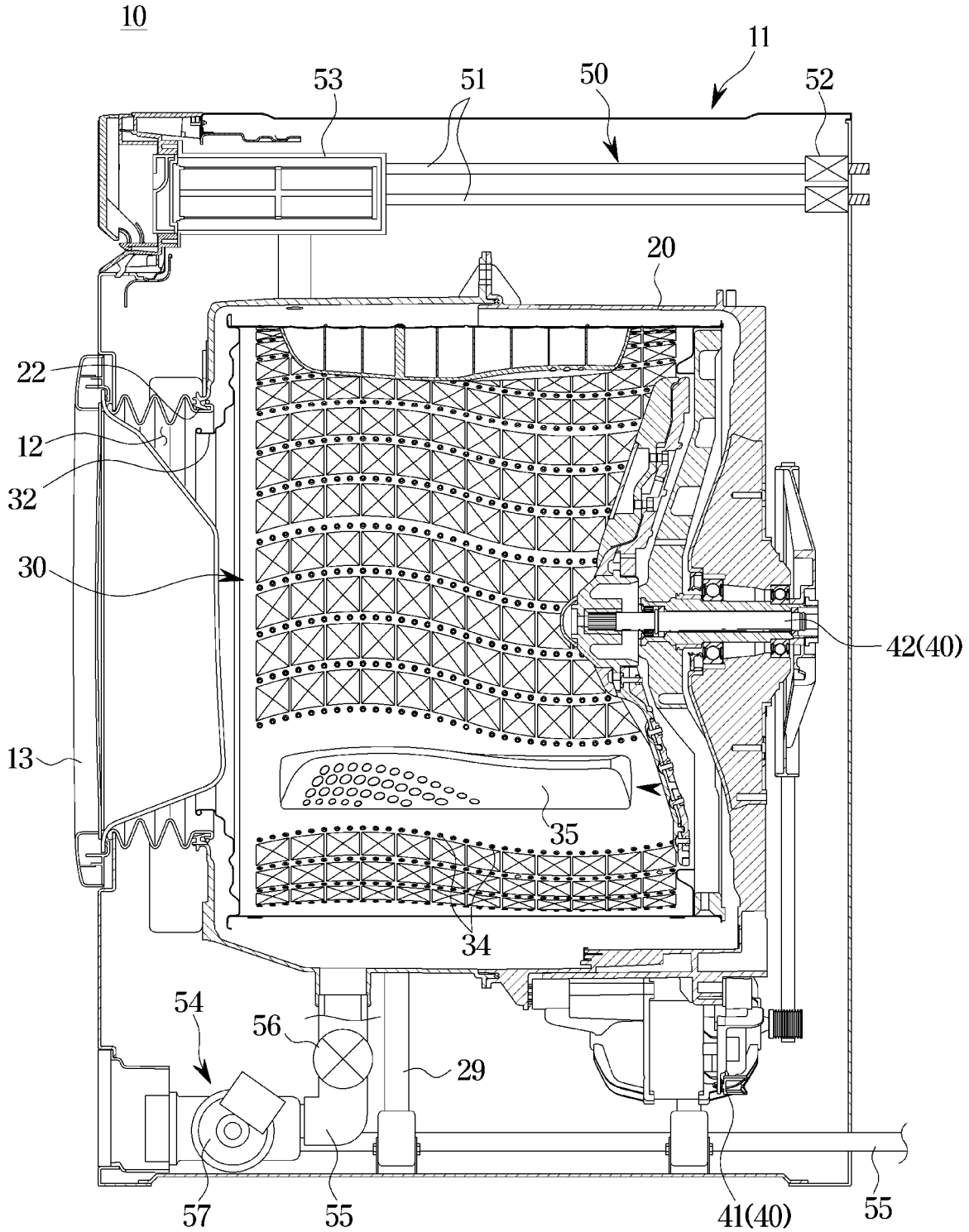
FIG. 3 illustrates a cross-sectional view of the first clothes treating apparatus of the clothes treating system according to an embodiment.
Figure 4:
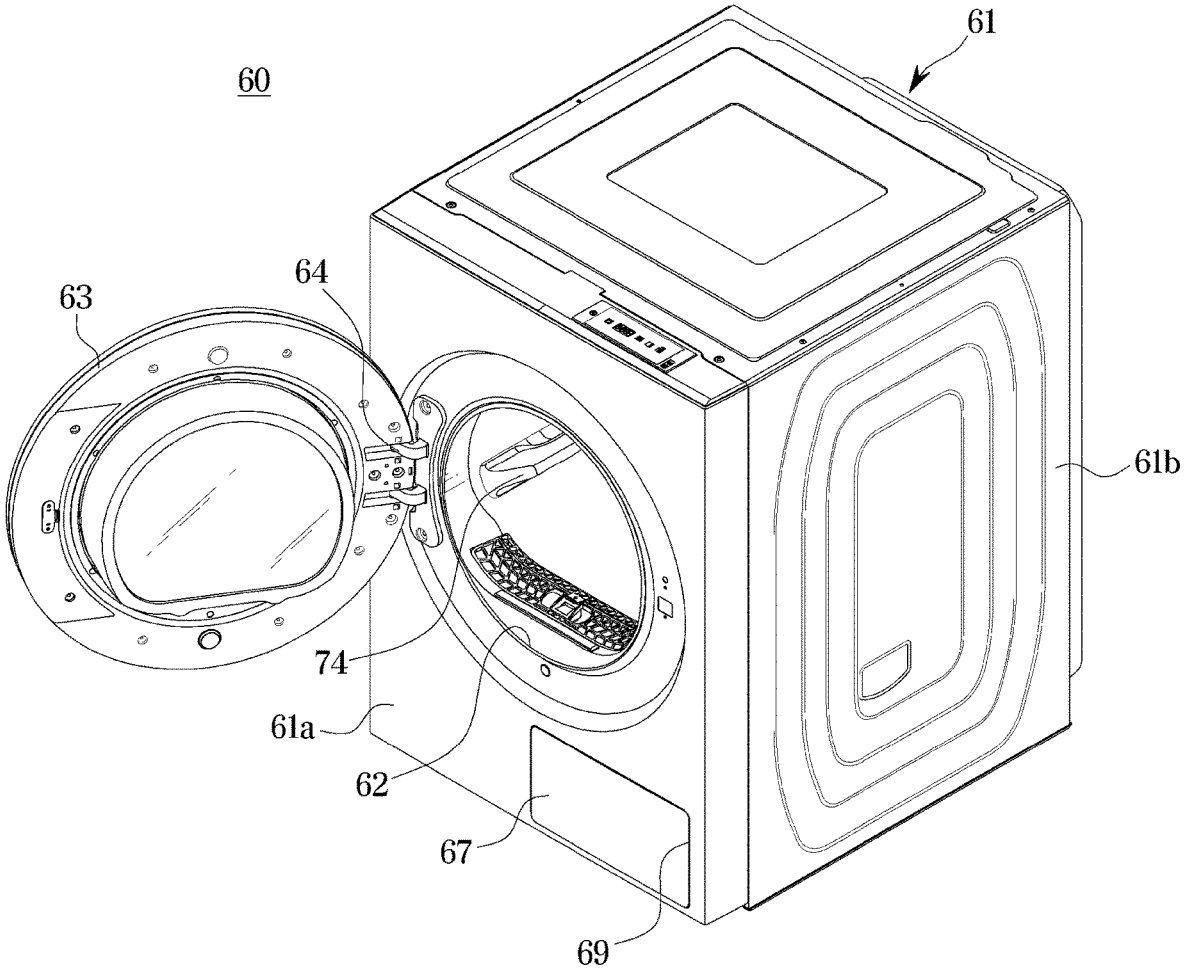
FIG. 4 illustrates a second clothes treating apparatus of the clothes treating system according to an embodiment.
Figure 5:
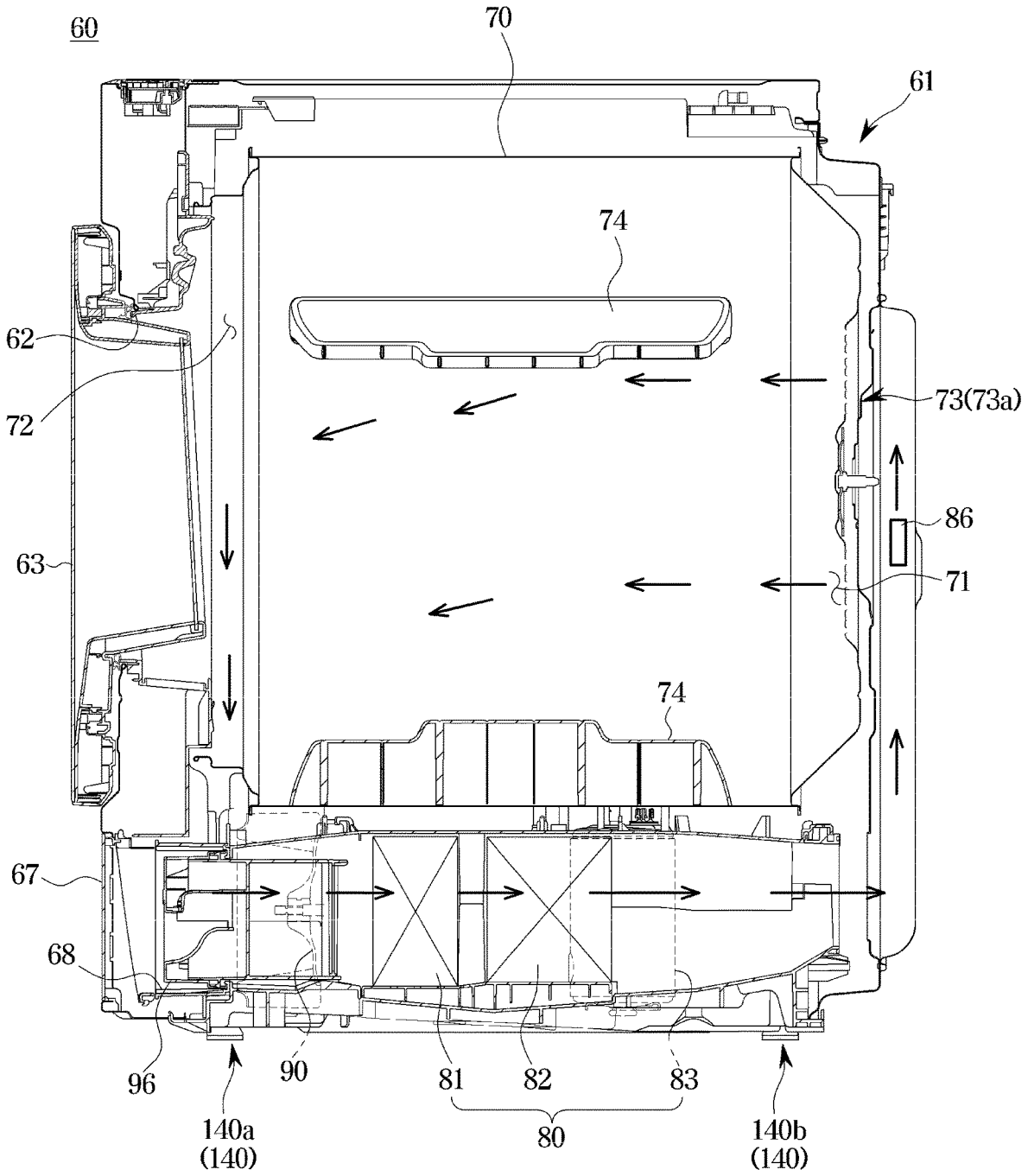
FIG. 5 illustrates a cross-sectional view of the second clothes treating apparatus of the clothes treating system according to an embodiment.

FIG. 1 illustrates a clothes treating system according to an embodiment. FIG. 2 illustrates a first clothes treating apparatus of the clothes treating system according to an embodiment. FIG. 3 illustrates a cross-sectional view of the first clothes treating apparatus of the clothes treating system according to an embodiment. FIG. 4 illustrates a second clothes treating apparatus of the clothes treating system according to an embodiment. FIG. 5 illustrates a cross-sectional view of the second clothes treating apparatus of the clothes treating system according to an embodiment.

As illustrated in FIG. 1, a clothes treating system 1 may include a first clothes treating apparatus 10 and a second clothes treating apparatus 60 mounted on the first clothes treating apparatus 10. The second clothes treating apparatus 60 may be provided on one side of the first clothes treating apparatus 10. For example, the second clothes treating apparatus 60 may be mounted at an upper end of the first clothes treating apparatus 10.

The first clothes treating apparatus 10 may be a washing machine or a dryer.

For example, the first clothes treating apparatus 10 may be a washing machine.

Referring to FIGS. 2 and 3, the first clothes treating apparatus 10 according to various embodiments may include a first housing 11 accommodating various components therein. The first housing 11 may be provided in the form of a box having a laundry inlet 12 formed on one side thereof.

The first clothes treating apparatus 10 may include a first front frame 11*a* forming a front surface thereof. The laundry inlet 12 may be formed on the first front frame 11*a*.

The first clothes treating apparatus 10 may include a first door 13 provided to open and close the laundry inlet 12. The first door 13 may be rotatably mounted to the first housing 11 by a first hinge 14. At least one portion of the first door 13 may be provided to be transparent or translucent so that the inside of the first housing 11 may be seen.

The first clothes treating apparatus 10 may include a tub 20 provided inside the first housing 11 to store water. The tub 20 may be provided in a substantially cylindrical shape with a tub opening 22 formed on one side thereof, and disposed inside the first housing 11 such that the tub opening 22 is disposed to correspond to the laundry inlet 12.

The tub 20 may be connected to the first housing 11 by a damper 29. The damper 29 may absorb vibration occurred when a first drum 30 rotates to damp the vibration transferred to the first housing 11.

The first clothes treating apparatus 10 may include the first drum 30 provided to accommodate laundry.

The first drum 30 may be disposed inside the tub 20 such that a first drum opening 32 provided on one side thereof corresponds to the laundry inlet 12 and the tub opening 22. Laundry may be accommodated in the first drum 30 or taken out of the first drum 30 by sequentially passing through the laundry inlet 12, the tub opening 22, and the first drum opening 32.

The first drum 30 may perform respective operations according to washing, rinsing, and/or dewatering processes while rotating inside the tub 20. A plurality of passing holes 34 is formed on a cylindrical wall of the first drum 30 so that water stored in the tub 20 may flow into the first drum 30 or flow out of the first drum 30. At least one first lifter 35 may be installed on an inner circumferential surface of the first drum 30 so that laundry may be raised and dropped when the first drum 30 rotates.

The first clothes treating apparatus 10 may include a first driving device 40 configured to rotate the first drum 30. The first driving device 40 may include a first driving motor 41 and a first rotating shaft 42 provided to transmit a driving force generated by the first driving motor 41 to the first drum 30. The first rotating shaft 42 may pass through the tub 20 to be connected to the first drum 30.

The first driving device 40 may perform each operation according to the washing, rinsing, and/or dewatering, or drying process by forward or reversely rotating the first drum 30.

The first clothes treating apparatus 10 may include a water supply device 50 configured to supply water to the tub 20. The water supply device 50 may include a water supply pipe 51 and a water supply valve 52 provided on the water supply pipe 51. The water supply pipe 51 may be connected to an external water supply source. The water supply pipe 51 may extend from an external water supply source to a detergent supply device 53 and/or the tub 20. Water may be supplied to the tub 20 through the detergent supply device 53. Water may be supplied to the tub 20 without passing through the detergent supply device 53.

Figure 6:
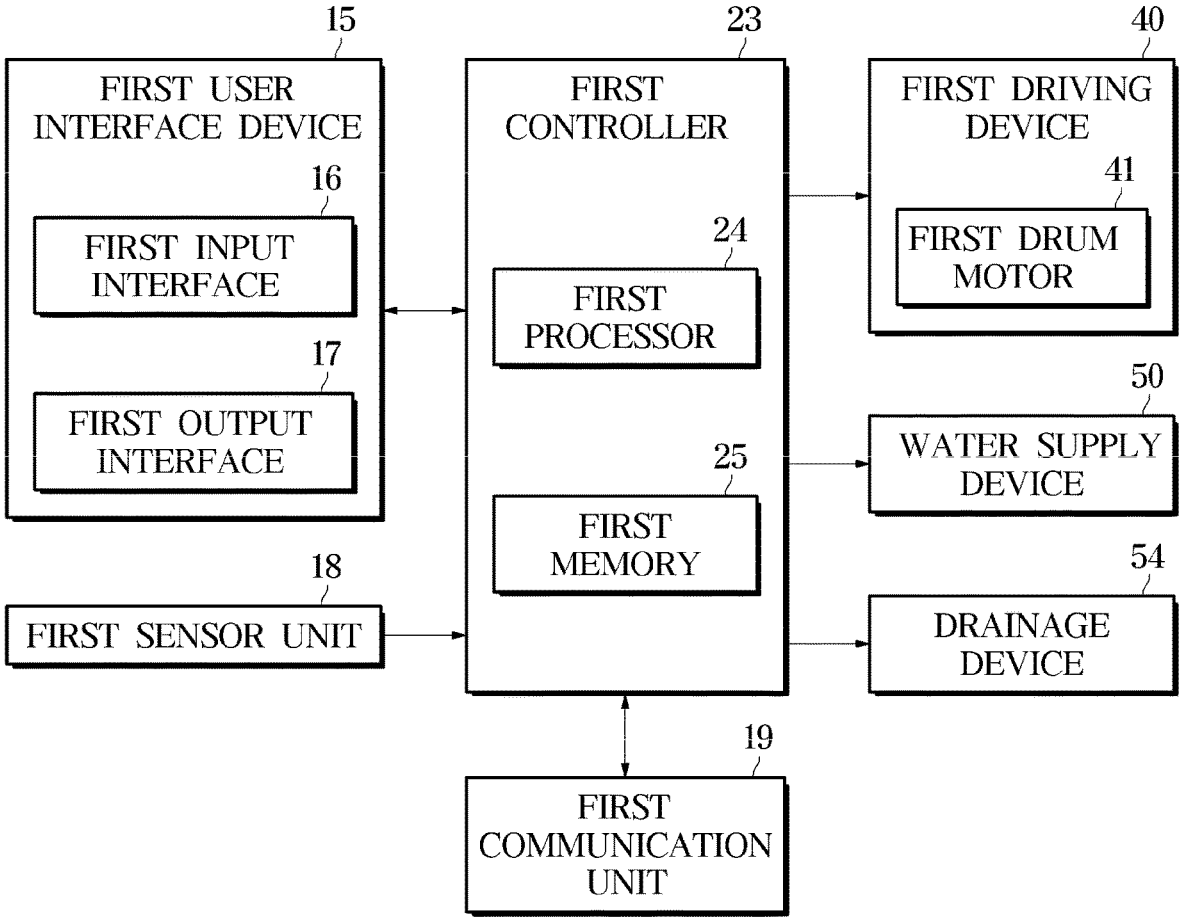
FIG. 6 is a control block diagram of the first clothes treating apparatus according to an embodiment.

The water supply valve 52 may open or close the water supply pipe 51 in response to an electrical signal of a first controller 23 (see FIG. 6). The water supply valve 52 may allow water to be supplied to the tub 20 or block water from being supplied to the tub 20, from the external water supply source. The water supply valve 52 may include, for example, a solenoid valve opening or closing in response to an electrical signal.

The first clothes treating apparatus 10 may include the detergent supply device 53 configured to supply detergent to the tub 20. The detergent supply device 53 may include a manual detergent supply device requiring a user to put detergent to be used for each washing, and an automatic detergent supply device storing a large amount of detergent and automatically putting a predetermined amount of detergent during washing. The detergent supply device 53 may include a detergent box for storing detergent. The detergent supply device 53 may be configured to supply the detergent into the tub 20 during a water supply process. Water supplied through the water supply pipe 51 may be mixed with the detergent by passing through the detergent supply device 53. Water mixed with detergent may be supplied into the tub 20. The detergent may be used as a term encompassing detergent for pre-washing, detergent for main washing, fabric softener, bleach, and the like, and the detergent box may be divided into a detergent storage area for pre-washing, a detergent storage area for main washing, a fabric softener storage area, and a bleaching agent storage area.

The first clothes treating apparatus 10 may include a drainage device 54 configured to discharge water accommodated in the tub 20 to the outside. The drainage device 54 may include a drain pipe 55 extending from a bottom of the tub 20 to the outside of the first housing 11, a drain valve 56 provided on the drain pipe 55 to open and close the drain pipe 55, and a pump 57 provided on the drain pipe 55. The pump 57 may pump water in the drain pipe 55 to the outside of the first housing 11.

According to various embodiments, the first clothes treating apparatus 10 may further include a heater for heating water stored in the tub 20.

According to various embodiments, the first clothes treating apparatus 10 may further include a heater for heating water that is supplied through the water supply device 50.

The second clothes treating apparatus 60 may be a washing machine or a dryer. For example, the second clothes treating apparatus 60 may be a dryer.

Referring to FIGS. 4 and 5, the second clothes treating apparatus 60 according to various embodiments may include a second housing 61 accommodating various components therein. The second housing 61 may be provided in the form of a box in which an object inlet 62 is formed on one side thereof.

The second clothes treating apparatus 60 may include a second front frame 61*a* forming a front surface thereof. The object inlet 62 may be formed on the second front frame 61*a*.

The second clothes treating apparatus 60 may include a second door 63 provided to open and close the object inlet 62. The second door 63 may be rotatably mounted to the second housing 61 by a second hinge 64. At least one portion of the second door 63 may be provided to be transparent or translucent so that the inside of the second housing 61 may be seen.

The second clothes treating apparatus 60 may include a second drum 70 provided to accommodate an object. The second drum 70 may be disposed inside the second housing 61 such that a second drum opening 72 provided on one side thereof corresponds to the object inlet 62. The object may be accommodated in the second drum 70 or taken out of the second drum 70 by sequentially passing through the object inlet 62 and the second drum opening 72. The second drum 70 may be rotatably provided inside the second housing 61.

The second clothes treating apparatus 60 may include a second driving device 73 configured to rotate the second drum 70. The second driving device 73 may include a second driving motor and a second rotating shaft provided to transmit a driving force generated by the second driving motor to the second drum 70.

The second drum 70 may include an air inlet 71 through which air is introduced into the second drum 70. Air inside the second drum 70 may be discharged to the outside of the second drum 70 through the second drum opening 72. The air inlet 71 may be positioned on a side opposite to one side of the second drum 70 where the second drum opening 72 is positioned. For example, the air inlet 71 may be positioned at the rear of the second drum 70, and the second drum opening 72 may be positioned at the front of the second drum 70.

High-temperature dry air may be introduced into the second drum 70 through the air inlet 71 to dry the object accommodated in the second drum 70. Air containing a large amount of moisture after drying the object may be discharged from the second drum 70 through the second drum opening 72.

At least one second lifter 74 may be provided inside the second drum 70. The second lifter 74 may raise and drop the object so that the object comes into contact with the hot air while floating in an inner space of the second drum 70.

Inside the second housing 61, a heat pump 80 configured to heat and condense air may be provided. An evaporator 81, a condenser 82, a compressor 83, an expansion device, and the like constituting the heat pump 80 may be disposed below the second drum 70. Refrigerant may be circulated through a series of processes leading to compression-condensation-expansion-evaporation. Specifically, the heat pump 80 may include the evaporator 81, the condenser 82, the compressor 83, and the expansion device. The evaporator 81 and the condenser 82 may exchange heat with air.

The compressor 83 compresses and discharges the refrigerant in a high-temperature and high-pressure state, and the discharged refrigerant may be introduced into the condenser 82. The condenser 82 may condense the compressed refrigerant and dissipate heat to the surroundings through the condensation process. The expansion device may expand the high-temperature and high-pressure refrigerant condensed in the condenser 82 to a low-pressure state. The evaporator 81 may evaporate the expanded refrigerant and take heat from the surroundings through the evaporation process.

As an operating RPM of the compressor 83 increases, an amount of heat radiated to the surroundings through the condensation process of the condenser 82 may increase.

When an object is put into the second clothes treating apparatus 60 and operated in a drying mode, high-temperature and high-humidity air discharged from the second drum 70 may pass through the evaporator 81. Accordingly, the high-temperature and high-humidity air discharged from the second drum 70 may be cooled while passing through the evaporator 81 and thus changed into low-temperature dry air. At this time, condensed water may be generated as the high-temperature and high-humidity air is cooled in the evaporator 81. The condensed water may be moved to a recovery water container or drained to the outside of the second housing 61. Air in a low-temperature dry state after passing through the evaporator 81 may pass through the condenser 82. Accordingly, the low-temperature dry air discharged from the evaporator 81 may be heated while passing through the condenser 82 and thus changed into high-temperature dry air. The high-temperature dry air may be introduced into the second drum 70 through the air inlet 71 to dry the object. As the object is dried, high-temperature and high-humidity air containing a large amount of moisture may be discharged through the second drum opening 72. The discharged air may pass through the evaporator 81 again. In summary, air may dry an object accommodated in the second drum 70 while circulating inside the second housing 61.

In the drying mode, a closed type flow path may be formed inside the second housing 61 of the second clothes treating apparatus 60. The closed type flow path may be an air movement path (refer to arrows in FIG. 5) formed to circulate air inside the second housing 61 through the heat pump 80 and the second drum 70. The closed type flow path may not communicate with the outside of the second housing 61 so that air outside the second housing 61 does not flow in or out. That is, the flow of air may form a closed loop.

The second clothes treating apparatus 60 may include a heater 86 provided in the closed type flow path. The heater 86 may be implemented through a heating coil, but is not limited thereto, and may be implemented through various known devices. The heater 86 may further heat the air heated while passing through the condenser 82 or heat the air sucked in from the outside without being heated through the heat pump 80.

Referring to FIG. 4, the second clothes treating apparatus 60 may include a housing opening 69 provided on a front surface of the second housing 61 to access the heat pump 80. A filter device 96 may be mounted inside the second housing 61 through the housing opening 69. Specifically, the filter device 96 may be detachably mounted on a device accommodating part 68 formed inside the second housing 61 through the housing opening 69. When the filter device 96 is mounted on the accommodating part 68, the second clothes treating apparatus 60 may perform the drying mode (drying operation) for drying objects such as clothes. In addition, a housing cover 67 may be provided on the front surface of the second housing 61 to open and close the housing opening 69.

In a state in which the housing cover 67 closes the housing opening 69, as a front surface of the housing cover 67 and the front surface of the second housing 61 are connected, a surface connected smoothly without a step is formed. When the filter device 96 is not mounted inside the second housing 61, the user may access the heat pump 80 through the housing opening 69. When the dryer is used for a long time, foreign substances such as lint may be attached to a heat exchanger, and the user may remove these foreign substances through the housing opening 69.

The filter device 96 may be detachably mounted on the second clothes treating apparatus 60. Specifically, the filter device 96 may be detachably mounted inside the second housing 61 through the housing opening 69. The filter device 96 may be mounted on the device accommodating part 68 or may be separate from the device accommodating part 68.

A fan 90 may be disposed below the second drum 70. The fan 90 may circulate air inside the second housing 61. The fan 90 may form a circulating airflow passing through the second drum 70 inside the second housing 61.

The second clothes treating apparatus 60 may include a fan motor 91 configured to rotate the fan 90.

The fan 90 may be rotated by a driving force generated from the fan motor 91.

According to various embodiments, the fan motor 91 for rotating the fan 90 and a second drum motor 73*a* for rotating the second drum 70 may be the same configuration.

In an embodiment, one of the motors 91 and 73*a* may be connected to rotating shafts different from each other to simultaneously rotate the fan 90 and the second drum 70.

When one of the motors 91 and 73*a* is connected to rotating shafts different from each other to simultaneously rotate the fan 90 and the second drum 70, a rotational speed of the fan 90 and a rotational speed of the second drum 70 may be different from each other. For example, the rotational speed of the fan 90 may be faster than the rotational speed of the second drum 70.

According to various embodiments, the fan motor 91 for rotating the fan 90 and the second drum motor 73*a* for rotating the second drum 70 may be provided separately from each other.

A leg 140 may be provided on a lower surface of the second clothes treating apparatus 60. The leg 140 may be provided on the lower surface of the second clothes treating apparatus 60 to support the second clothes treating apparatus 60.

FIG. 6 is a control block diagram of the first clothes treating apparatus according to an embodiment.

Referring to FIG. 6, in an embodiment, the first clothes treating apparatus 10 may include a first user interface device 15, the first driving device 40, the water supply device 50, the drainage device 54, a first sensor unit 18, a first communication unit 19, and the first controller 23.

The first user interface device 15 may provide a user interface for interaction between the user and the first clothes treating apparatus 10.

The first user interface device 15 may include at least one first input interface 16 and at least one first output interface 17.

In an embodiment, the first user interface device 15 may be disposed on one side of the first housing 11, but the position of the first user interface device 15 is not limited thereto.

The at least one first input interface 16 may convert sensory information received from the user into an electrical signal.

The at least one first input interface 16 may include a power button, an operation button, a course selection dial (or course selection button), and washing/rinsing/dewatering setting buttons. The at least one first input interface 16 may include, for example, a tact switch, a push switch, a slide switch, a toggle switch, a micro switch, a touch switch, a touch pad, a touch screen, a jog dial, and/or a microphone, and the like.

The at least one first output interface 17 may transfer various data related to operations of the first clothes treating apparatus 10 to the user by generating sensory information.

For example, the at least one first output interface 17 may transfer information related to a washing course, an operating time of the first clothes treating apparatus 10, and washing/rinsing/dewatering settings to the user. Information on the operations of the first clothes treating apparatus 10 may be output through a screen, indicator, voice, and the like. The at least one first output interface 17 may include, for example, a liquid crystal display (LCD) panel, a light emitting diode (LED) panel, a speaker, and the like.

The washing course may include washing settings (e.g., washing temperature, number of rinsing, dewatering intensity, etc.) preset by a designer of the first clothes treating apparatus 10 depending on the type (e.g., blanket, underwear, etc.) and material (e.g., wool, etc.) of laundry. For example, standard washing may include washing settings that may be applied to most laundry, and blanket washing may include an optimized washing setting for washing a blanket. The washing course may be classified into, for example, standard washing, strong washing, delicate clothing washing, blanket washing, baby clothing washing, towel washing, small amount washing, boiling washing, power saving washing, outdoor clothing washing, rinsing/dewatering, dewatering, and the like.

According to various embodiments, the washing course may include a plurality of courses tailored to user needs. For example, the washing course may include an energy saving course, a time saving course, a low noise course, and the like.

The energy saving course corresponds to a course for minimizing energy required to perform a washing cycle. When the first clothes treating apparatus 10 performs the washing cycle corresponding to the energy saving course, an operation of the heater for heating water stored in the tub 20 may be minimized.

The time saving course corresponds to a course for minimizing the time required to perform the washing cycle. When the first clothes treating apparatus 10 performs the washing cycle corresponding to the time saving course, the number of times of washing process, rinsing process, and/or dewatering process may be minimized, or the time required for washing process, rinsing process, and/or dewatering process may be minimized.

The low noise course corresponds to a course for minimizing noise occurred from the first clothes treating apparatus 10 while performing the washing cycle. When the first clothes treating apparatus 10 performs the washing cycle corresponding to the low noise course, a maximum RPM of the first drum 30 may be minimized in the washing process, the rinsing process and/or the dewatering process.

In the present disclosure, courses depending on special needs of the user, such as the energy saving course, the time saving course, and the low noise course, may be defined as specialized courses.

In the present disclosure, the courses other than the specialized courses (e.g., standard courses) may be defined as general courses.

A first memory 25 may store algorithms of a plurality of the washing courses corresponding to the plurality of washing courses. The algorithms of the plurality of washing courses refer to algorithms for controlling a plurality of components (e.g., the first driving device 40, the water supply device 50, the drainage device 54, and/or the heater) in the washing cycle.

A first processor 24 may perform a washing course based on an algorithm of an operation course set based on a user input among the algorithms of the plurality of washing courses stored in the first memory 25.

The first driving device 40 may include the first drum motor 41 for providing a driving force for rotating the first drum 30. The first driving device 40 may operate based on a control signal of the first controller 23.

The water supply device 50 may include the water supply valve 52 provided to open and close the water supply pipe 51 extending from an external water supply source to the detergent supply device 53 and/or the tub 20. The water supply valve 52 may be opened and closed based on a control signal of the first controller 23.

The drainage device 54 may include the drainage pump 57 provided to discharge water from the tub 20 to the outside of the washing machine housing 11. The drainage pump 57 may operate based on a control signal of the first controller 23.

The first sensor unit 18 may include at least one sensor provided to obtain information related to an operating state of the first clothes treating apparatus 10.

For example, the first sensor unit 18 may include at least one of a water level sensor provided to detect a water level of the tub 20, a sensor provided to detect an operating state of the first driving device 40, a flow sensor provided to detect a flow rate introduced into the tub 20 through the water supply device 50, and a sensor provided to detect an operating state of the drainage device 54.

According to various embodiments, the first sensor unit 18 may include at least one sensor provided to detect a weight of laundry accommodated in the first drum 30.

According to various embodiments, the first sensor unit 18 may include a vibration sensor provided to detect a vibration value of the tub 20. The vibration sensor may detect vibration of the tub 20. Specifically, the vibration sensor may detect vibration of the tub 20 occurred by rotation of the first drum 30 during the washing cycle (e.g., the dewatering process). Eccentricity of the first drum 30 may occur due to unbalance of laundry disposed inside the first drum 30, and vibration of the tub 20 may occur due to the eccentricity of the first drum 30. When a rotational speed of the first drum 30 increases in a state in which the laundry is disposed to be unbalanced, the vibration of the tub 20 may increase, and the noise caused by the vibration of the tub 20 may also increase.

According to various embodiments, even when the first clothes treating apparatus 10 and the second clothes treating apparatus 60 operate together, the vibration of the tub 20 may increase due to frequency resonance.

The vibration sensor may output a vibration signal related to vibration of the tub 20. An amplitude of the vibration signal may be defined as a vibration value when the tub 20 vibrates.

In an embodiment, the first controller 23 may convert a vibration signal in a time domain output from the vibration sensor into a vibration signal in a frequency domain, and process the vibration signal in the frequency domain. The vibration sensor may include a six-axis sensor capable of detecting displacement in six axes (X, Y, Z, Pitch, Roll, and Yaw).

The sensor provided to detect the operating state of the first driving device 40 may include, for example, a current sensor measuring a driving current applied to the first drum motor 41, but is not limited thereto.

The sensor provided to detect the operating state of the drainage device 54 may include, for example, a current sensor provided to measure a driving current applied to the drainage pump 57, but is not limited thereto.

The first clothes treating apparatus 10 may include the first communication unit 19 for wired and/or wireless communication with external devices (e.g., servers, user devices, and/or other home appliances).

The user devices and/or other home appliances may include various electronic devices such as smartphones, notebooks, laptops, smart watches, IoT hub devices, other home appliances such as a television and/or the second clothes treating apparatus 60, holder-type tablets, and speakers.

The first communication unit 19 may include a short-range communication module and/or a long-range communication module.

The first communication unit 19 may transfer data to an external device or receive data from an external device. For example, the first communication unit 19 may establish communication with servers, user devices, and/or other home appliances, and transfer/receive various types of data.

To this end, the first communication unit 19 may support establishment of a direct (e.g., wired) communication channel or wireless communication channel between external devices, and communication through the established communication channel. According to an embodiment, the first communication unit 19 may include a wireless communication module (e.g., a cellular communication module, a short-range wireless communication module, or a global navigation satellite system (GNSS) communication module) or a wired communication module (e.g., a local area network (LAN) communication module, or a power line communication module). A corresponding communication module among these communication modules may communicate with external devices through a first network (e.g., a short-range communication network such as Bluetooth, wireless fidelity (Wi-Fi) direct, and infrared data association (IrDA)) or a second network (e.g., a long-range communication network such as a legacy cellular network, a 5G network, a next-generation telecommunications network, the Internet, and a computer network (e.g. LAN or WAN)). These various types of communication modules may be integrated as one component (e.g., a single chip) or implemented as a plurality of separate components (e.g., a plurality of chips).

The short-range wireless communication modules may include, but are not limited to, a Bluetooth communication module, a Bluetooth low energy (BLE) communication module, a near field communication module, a WLAN (Wi-Fi) communication module, a ZigBee communication module, an infrared data association (IrDA) communication module, a Wi-Fi direct (WFD) communication module, an ultra-wideband (UWB) communication module, an Ant+ communication module, a microwave (uWave) communication module, and the like.

The long-range communication modules may include communication modules that perform various types of long distance communications, and may include mobile communication units. The mobile communication unit transfers and receives radio signals with at least one of a base station, an external terminal, and a server on a mobile communication network.

In an embodiment, the first communication unit 19 may communicate with an external device such as a server, user device, and other home appliance through a nearby access point (AP). The access point may connect a local area network (LAN) to which the first clothes treating apparatus 10 and/or a user device and/or other home appliance are connected, to a wide area network (WAN) to which a server is connected. The first clothes treating apparatus 10 and/or the user device and/or the other home appliance may be connected to the server through the wide area network (WAN).

The first controller 23 may control various components (e.g., the first driving device 40, the water supply device 50, and the drainage device 54) of the first clothes treating apparatus 10. The first controller 23 may control various components of the first clothes treating apparatus 10 to perform at least one process including water supply, washing, rinsing, and/or dewatering depending on the user input. For example, the first controller 23 may control the first drum motor 41 of the first driving device 40 to adjust the rotational speed (RPM) of the first drum 30, control the water supply valve 52 of the water supply device 50 to supply water to the tub 20, or control the drainage pump 57 of the drainage device 54 to discharge water in the tub 20 to the outside.

The first controller 23 may include hardware such as a CPU, a microcomputer and a memory, and software such as a control program. For example, the first controller 23 may include algorithms for controlling operations of the components in the first clothes treating apparatus 10, the at least one first memory 25 for storing data in the form of a program, and the at least one first processor 24 for performing the above-described operations and operations, which will be described later, using data stored in the at least one first memory 25. The first memory 25 and the first processor 24 may be implemented as separate chips. The first processor 24 may include one or more processor chips or may include one or more processing cores. The first memory 25 may include one or more memory chips or may include one or more memory blocks. The first memory 25 and the first processor 24 may be implemented as a single chip.

Figure 7:
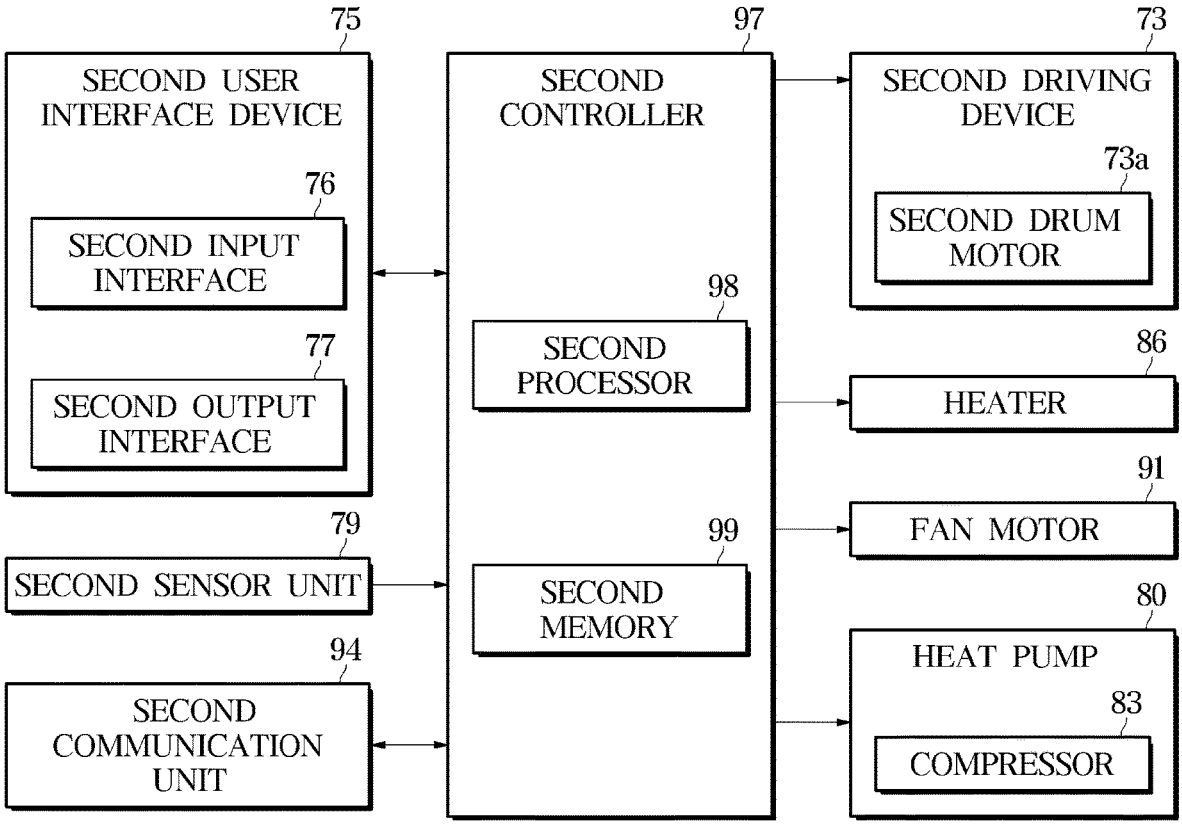
FIG. 7 is a control block diagram of the second clothes treating apparatus according to an embodiment.

FIG. 7 is a control block diagram of the second clothes treating apparatus according to an embodiment.

Referring to FIG. 7, in an embodiment, the second clothes treating apparatus 60 may include a second user interface device 75, the second driving device 73, the heater 86, and the fan motor 91, the heat pump 80, a second communication unit 94, a second sensor unit 79, and a second controller 97.

The second user interface device 75 may provide a user interface for interaction between the user and the second clothes treating apparatus 60.

The second user interface device 75 may include at least one second input interface 76 and at least one second output interface 77.

In an embodiment, the second user interface device 75 may be disposed on one side of the second housing 61, but the position of the second user interface device 75 is not limited thereto.

The at least one second input interface 76 may convert sensory information received from the user into an electrical signal.

The at least one second input interface 76 may include a power button, an operation button, a course selection dial (or course selection button), and a drying setting button. The at least one second input interface 76 may include, for example, a tact switch, a push switch, a slide switch, a toggle switch, a micro switch, a touch switch, a touch pad, a touch screen, a jog dial, and/or a microphone, and the like.

The at least one second output interface 77 may transfer various data related to operations of the second clothes treating apparatus 60 to the user by generating sensory information.

For example, the at least one second output interface 77 may transfer information related to a drying course, an operating time of the second clothes treating apparatus 60 and a drying setting to the user. Information on the operations of the second clothes treating apparatus 60 may be output through a screen, indicator, voice, and the like. The at least one second output interface 77 may include, for example, a liquid crystal display (LCD) panel, a light emitting diode (LED) panel, a speaker, and the like.

The drying course may include drying settings (e.g., drying temperature, drying time, drying intensity, etc.) preset by a designer of the second clothes treating apparatus 60 depending on the type (e.g., blanket, underwear, etc.) and material (e.g., wool, etc.) of an object. For example, standard drying may include drying settings that may be applied to most objects, and blanket drying may include an optimized drying setting for drying a blanket. The drying course may be classified into, for example, standard drying, strong drying, delicate clothing drying, blanket drying, baby clothing drying, towel drying, small amount drying, power saving drying, outdoor clothing drying, and the like.

According to various embodiments, the drying course may include a plurality of courses tailored to user needs. For example, the drying course may include an energy saving course, a time saving course, a low noise course, and the like.

The energy saving course corresponds to a course for minimizing energy required to perform a drying process. When the second clothes treating apparatus 60 performs the drying process corresponding to the energy saving course, an operation of the heater 86 may be minimized.

The time saving course corresponds to a course for minimizing the time required to perform the drying process. When the second clothes treating apparatus 60 performs the drying process corresponding to the time saving course, an operating time of the heater 86 and/or an operating frequency of the compressor 83 may increase.

The low noise course corresponds to a course for minimizing noise occurred from the second clothes treating apparatus 60 while performing the drying process. When the second clothes treating apparatus 60 performs the drying process corresponding to the low noise course, a maximum RPM of the second drum 70 may be minimized.

In the present disclosure, courses depending on special needs of the user, such as the energy saving course, the time saving course, and the low noise course, may be defined as specialized courses.

In the present disclosure, the courses other than the specialized courses (e.g., standard courses) may be defined as general courses.

A second memory 99 may store algorithms of a plurality of the drying courses corresponding to the plurality of drying courses. The algorithms of the plurality of drying courses refer to algorithms for controlling a plurality of components (e.g., the second driving device 73, the heater 86, the fan motor 91, and/or the compressor 83) in the drying process.

A second processor 98 may perform a drying process based on an algorithm of an operation course set based on the user input among the algorithms of the plurality of drying courses stored in the second memory 99.

The second driving device 73 may include the second drum motor 73*a* providing a driving force for rotating the second drum 70. The second driving device 73 may operate based on a control signal of the second controller 97.

According to various embodiments, the second controller 97 may control the second driving device 73 based on the algorithm of the operation course selected by the user.

The heater 86 may further heat the air heated while passing through the condenser 82 or heat the air sucked in from the outside without being heated through the heat pump 80.

The heater 86 may operate based on a control signal of the second controller 97.

According to various embodiments, the second controller 97 may control the heater 86 based on the algorithm of the operation course selected by the user.

The fan motor 91 may rotate the fan 90 for circulating air in the second housing 61.

The fan motor 91 may operate based on a control signal of the second controller 97.

According to various embodiments, the second controller 97 may control the fan motor 91 based on the algorithm of the operating course selected by the user.

As described above, the fan motor 91 for rotating the fan 90 and the second drum motor 73*a* for rotating the second drum 70 may be the same configuration.

In an embodiment, when one of the motors 91 and 73*a* is connected to rotating shafts different from each other to simultaneously rotate the fan 90 and the second drum 70, the second controller 97 may drive one of the motors 91 and 73*a* at a target RPM corresponding to a target RPM of the fan 90 or a target RPM of the second drum 70.

According to various embodiments, when the fan motor 91 for rotating the fan 90 and the second drum motor 73*a* for rotating the second drum 70 are provided separately from each other, the second controller 97 may drive the fan motor 91 based on the target RPM of the fan 90, and drive the second drum motor 73*a* based on the target RPM of the second drum 70.

The heat pump 80 configured to generate hot air to be supplied to the second drum 70 may include the compressor 83 compressing the refrigerant.

The compressor 83 may operate based on a control signal of the second controller 97.

According to various embodiments, the second controller 97 may control the compressor 83 based on the algorithm of the operation course selected by the user.

The second sensor unit 79 may include at least one sensor provided to obtain information related to an operating state of the second clothes treating apparatus 60.

According to various embodiments, the second sensor unit 79 may include at least one sensor provided to detect a weight of an object accommodated in the second drum 70.

According to various embodiments, the second sensor unit 79 may include a temperature sensor provided to detect a temperature in the second housing 61 and/or a sensor provided to detect an operating state of the second driving device 73.

The temperature sensor detecting the temperature in the second housing 61 may be provided anywhere inside the second housing 61. According to various embodiments, the temperature sensor may be provided on an outlet side of the condenser 82 or may be provided on a downstream side of the heater 86.

According to various embodiments, the second sensor unit 79 may include a vibration sensor provided to detect a vibration value of the second housing 61.

The second clothes treating apparatus 60 may include the second communication unit 94 for wired and/or wireless communication with external devices (e.g., servers, user devices, and/or other home appliances).

The user devices and/or other home appliances may include various electronic devices such as smartphones, notebooks, laptops, smart watches, IoT hub devices, other home appliances such as a television and/or the second clothes treating apparatus 60, holder-type tablets, and speakers.

The second communication unit 94 may include a short-range communication module and/or a long-range communication module.

The second communication unit 94 may transfer data to an external device or receive data from an external device. For example, the second communication unit 94 may establish communication with servers, user devices, and/or other home appliances, and transfer/receive various types of data.

To this end, the second communication unit 94 may support establishment of a direct (e.g., wired) communication channel or wireless communication channel between external devices, and communication through the established communication channel. According to an embodiment, the second communication unit 94 may include a wireless communication module (e.g., a cellular communication module, a short-range wireless communication module, or a global navigation satellite system (GNSS) communication module) or a wired communication module (e.g., a local area network (LAN) communication module, or a power line communication module). A corresponding communication module among these communication modules may communicate with external devices through a first network (e.g., a short-range communication network such as Bluetooth, wireless fidelity (Wi-Fi) direct, and infrared data association (IrDA)) or a second network (e.g., a long-range communication network such as a legacy cellular network, a 5G network, a next-generation telecommunications network, the Internet, and a computer network (e.g. LAN or WAN)). These various types of communication modules may be integrated as one component (e.g., a single chip) or implemented as a plurality of separate components (e.g., a plurality of chips).

The short-range wireless communication modules may include, but are not limited to, a Bluetooth communication module, a Bluetooth low energy (BLE) communication module, a near field communication module, a WLAN (Wi-Fi) communication module, a ZigBee communication module, an infrared data association (IrDA) communication module, a Wi-Fi direct (WFD) communication module, an ultra-wideband (UWB) communication module, an Ant+ communication module, a microwave (uWave) communication module, and the like.

The long-range communication modules may include communication modules that perform various types of long distance communications, and may include mobile communication units. The mobile communication unit transfers and receives radio signals with at least one of a base station, an external terminal, and a server on a mobile communication network.

In an embodiment, the second communication unit 94 may communicate with an external device such as a server, user device, and other home appliance through a nearby access point. The access point may connect a local area network (LAN) to which the second clothes treating apparatus 60 and/or a user device and/or other home appliance are connected, to a wide area network (WAN) to which a server is connected. The second clothes treating apparatus 60 and/or the user device and/or the other home appliance may be connected to the server through the wide area network (WAN).

The second controller 97 may control various components (e.g., the second driving device 73, the heater 86, the fan motor 91, and/or the compressor 83) of the second clothes treating apparatus 60. The second controller 97 may control various components of the second clothes treating apparatus 60 to perform the drying process depending on the user input. For example, the second controller 97 may control the second drum motor 73*a* of the second driving device 73 to adjust the rotational speed (RPM) of the second drum 70, control the operation of the heater 86 to quickly heat air in the second drum 70, control an operation of the compressor 83 to generate hot air to be supplied to the second drum 70, or control an operation of the fan motor 91 to circulate hot air generated by the heat pump 80 into the second drum 70.

The second controller 97 may include hardware such as a CPU, a microcomputer and a memory, and software such as a control program. For example, the second controller 97 may include algorithms for controlling operations of the components in the second clothes treating apparatus 60, the at least one second memory 99 for storing data in the form of a program, and the at least one second processor 98 for performing the above-described operations and operations, which will be described later, using data stored in the at least one second memory 99. The second memory 99 and the second processor 98 may be implemented as separate chips. The second processor 98 may include one or more processor chips or may include one or more processing cores. The second memory 99 may include one or more memory chips or may include one or more memory blocks. The second memory 99 and the second processor 98 may be implemented as a single chip.

Figure 8:
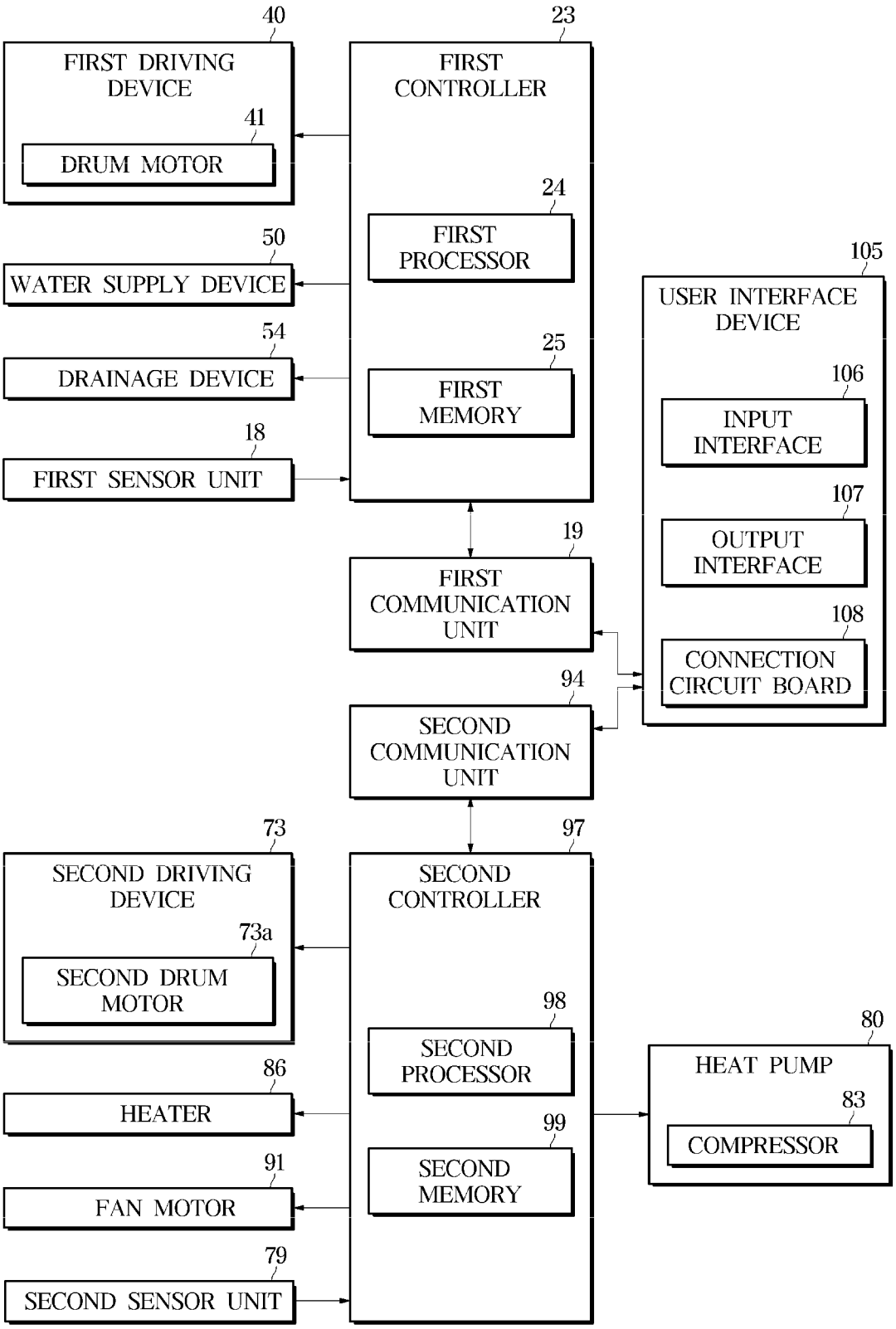
FIG. 8 is a control block diagram of the clothes treating system according to an embodiment.

FIG. 8 is a control block diagram of the clothes treating system according to an embodiment.

Referring to FIG. 8, the clothes treating system 1 according to an embodiment may include the first clothes treating apparatus 10 and the second clothes treating apparatus 60.

The first clothes treating apparatus 10 and the second clothes treating apparatus 60 may be operatively and/or electrically connected to each other.

A variety of information obtained from the first clothes treating apparatus 10 may be transferred to the second clothes treating apparatus 60, and a variety of information obtained from the second clothes treating apparatus 60 may be transferred to the first clothes treating apparatus 10.

In an embodiment, the clothes treating system 1 may include a user interface device 105.

The user interface device 105 may be provided in the first clothes treating apparatus 10 and/or the second clothes treating apparatus 60.

In an embodiment, the user interface device 105 may be disposed on one side surface of the first housing 11.

The user interface device 105 of the clothes treating system 1, which is a component for controlling both the first clothes treating apparatus 10 and the second clothes treating apparatus 60, may be defined as the integrated user interface device 105.

In an embodiment, as the clothes treating system 1 includes the user interface device 105, the first clothes treating apparatus 10 may not include the first user interface device 15 for controlling only the first clothes treating apparatus 10.

In an embodiment, as the clothes treating system 1 includes the user interface device 105, the second clothes treating apparatus 60 may not include the second user interface device 75 for controlling only the second clothes treating apparatus 60.

According to various embodiments, even when the clothes treating system 1 includes the user interface device 105, the first clothes treating apparatus 10 may include the first user interface device 15 for controlling only the first clothes treating apparatus 10. As another example, even when the clothes treating system 1 includes the user interface device 105, the second clothes treating apparatus 60 may include the second user interface device 75 for controlling only the second clothes treating apparatus 60. As another example, even when the clothes treating system 1 includes the user interface device 105, the first clothes treating apparatus 10 may include the first user interface device 15 for controlling only the first clothes treating apparatus 10, and the second clothes treating apparatus 60 may include the second user interface device 75 for controlling only the second clothes treating apparatus 60.

That is, in an embodiment, the clothes treating system 1 may include the user interface device 105 for controlling the first clothes treating apparatus 10 and the second clothes treating apparatus 60, and the first user interface device 15 for controlling the first clothes treating apparatus 10 and/or the second user interface device 75 for controlling the second clothes treating apparatus 60.

The user interface device 105 may provide a user interface for interaction between the user and the clothes treating system 1. The user interface for interaction between the user and the clothes treating system 1 may refer to user interfaces for interaction between the user and the first clothes treating apparatus 10 and the second clothes treating apparatus 60.

The user interface device 105 may include at least one input interface 106 and at least one output interface 107.

The at least one input interface 106 may convert sensory information received from the user into an electrical signal and transfer the electrical signal to the first clothes treating apparatus 10 and/or the second clothes treating apparatus 60.

The at least one input interface 106 may include a tact switch, a push switch, a slide switch, a toggle switch, a micro switch, a touch switch, a touch pad, a touch screen, a jog dial, and/or a microphone, and the like.

In an embodiment, the at least one input interface 106 may transmit a control command corresponding to a user input to the first controller 23 of the first clothes treating apparatus 10 and the second controller 97 of the second clothes treating apparatus 60.

The at least one output interface 107 may transfer various data related to operations of the first clothes treating apparatus 10 and the second clothes treating apparatus 60 to the user by generating sensory information.

The at least one output interface 107 may include, for example, a liquid crystal display (LCD) panel, a light emitting diode (LED) panel, a speaker, and the like.

A panel on which the at least one input interface 106 and the at least one output interface 107 are formed may be defined as a control panel 101. The at least one input interface 106 and the at least one output interface 107 may be provided on the control panel 101.

The first clothes treating apparatus 10 and the second clothes treating apparatus 60 may communicate with each other through the first communication unit 19 of the first clothes treating apparatus 10 and the second communication unit 94 of the second clothes treating apparatus 60.

In an embodiment, the first communication unit 19 and the second communication unit 94 may directly communicate with each other using a D2D wireless communication module (e.g., a Bluetooth module).

In an embodiment, the first communication unit 19 and the second communication unit 94 may communicate with each other through a server using a wide area network (WAN).

According to various embodiments, the first communication unit 19 and the second communication unit 94 may include wired communication modules (e.g., communication connectors and/or communication wires), and the first clothes treating apparatus 10 and the second clothes treating apparatus 60 may be connected to each other by wires.

According to various embodiments, the user interface device 105 may further include a connection circuit board 108. The connection circuit board 108 may be implemented as a printed circuit board.

The connection circuit board 108 may include a communication wire and/or a communication connector to be connected to the first communication unit 19 and the second communication unit 94.

The connection circuit board 108 may connect the first communication unit 19 and the second communication unit 94 by a wire.

Each of the first communication unit 19 and the second communication unit 94 may be connected to the connection circuit board 108.

The connection circuit board 108 may mediate data exchange between the first controller 23 and the second controller 97.

For example, the connection circuit board 108 may transfer a signal transferred from the first controller 23 through the first communication unit 19 to the second controller 97 through the second communication unit 94.

As another example, the connection circuit board 108 may transfer a signal transferred from the second controller 97 through the second communication unit 94 to the first controller 23 through the first communication unit 19.

According to various embodiments, the connection circuit board 108 may transfer course information selected by the at least one input interface 106 to the first controller 23 through the first communication unit 19.

According to various embodiments, the connection circuit board 108 may transfer course information selected by the at least one input interface 106 to the second controller 97 through the second communication unit 94.

According to the present disclosure, as the user interface device 105 includes the connection circuit board 108, communication between the first clothes treating apparatus 10 and the second clothes treating apparatus 60 may be smoothly performed, and at the same time, communication between the user interface device 100 and the first clothes treating apparatus 10 and the second clothes treating apparatus 60 may be smoothly performed.

Figure 9:
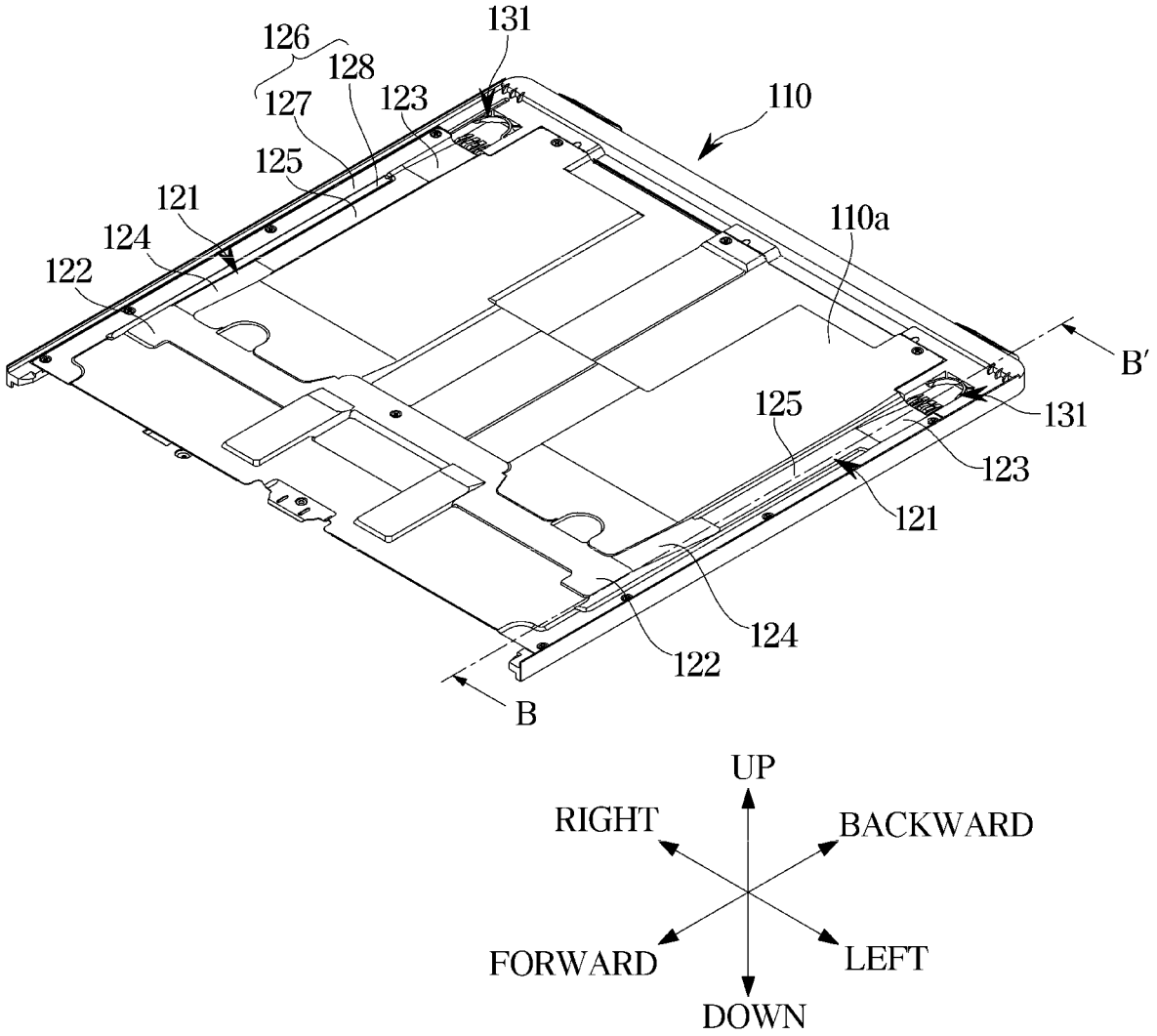
FIG. 9 separately illustrates an upper surface of a first housing in the first clothes treating apparatus of the clothes treating system according to an embodiment.

FIG. 9 separately illustrates an upper surface of a first housing in the first clothes treating apparatus of the clothes treating system according to an embodiment.

Figure 10:
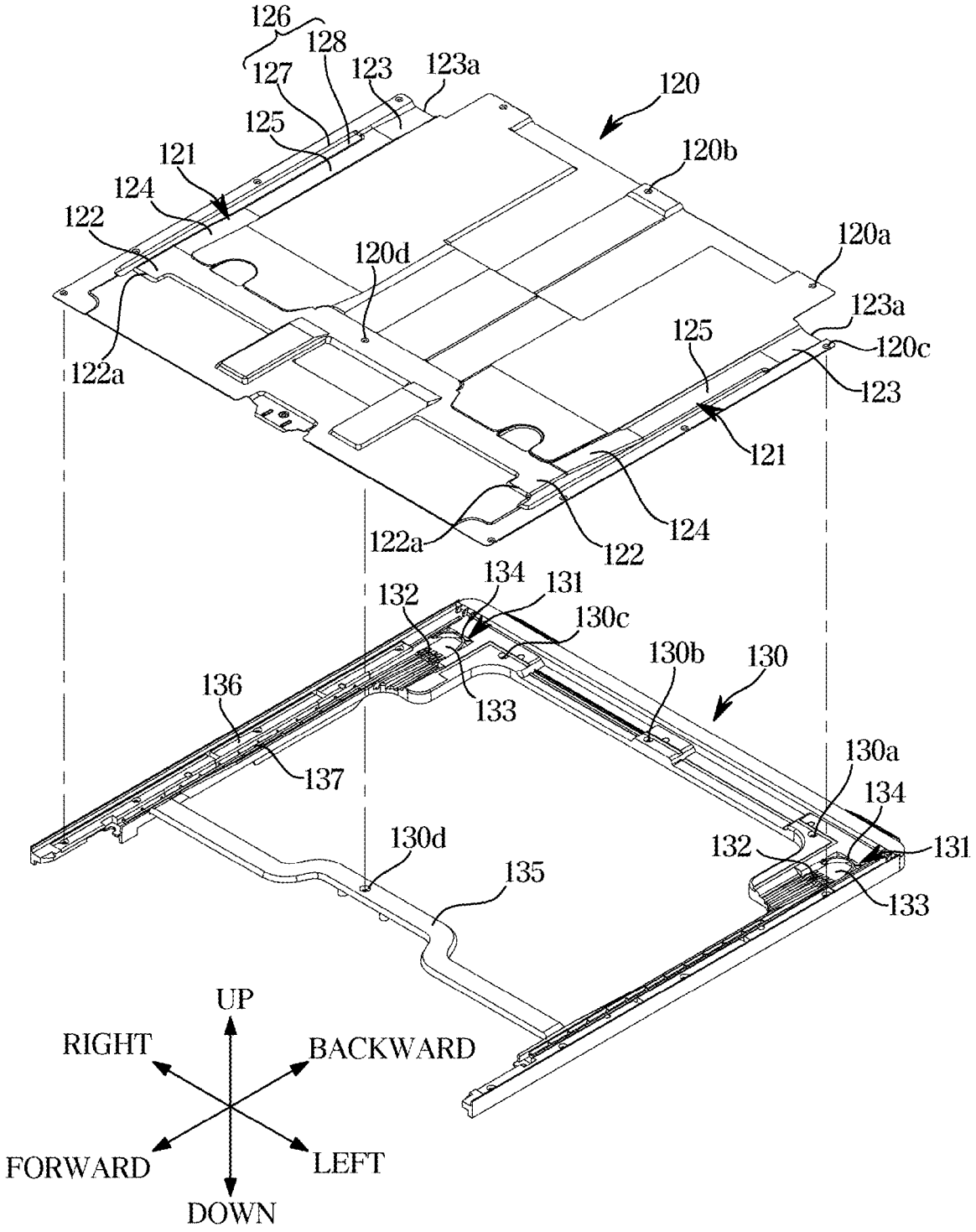
FIG. 10 is an exploded view of the upper surface of the first housing illustrated in FIG. 9.
Figure 11:
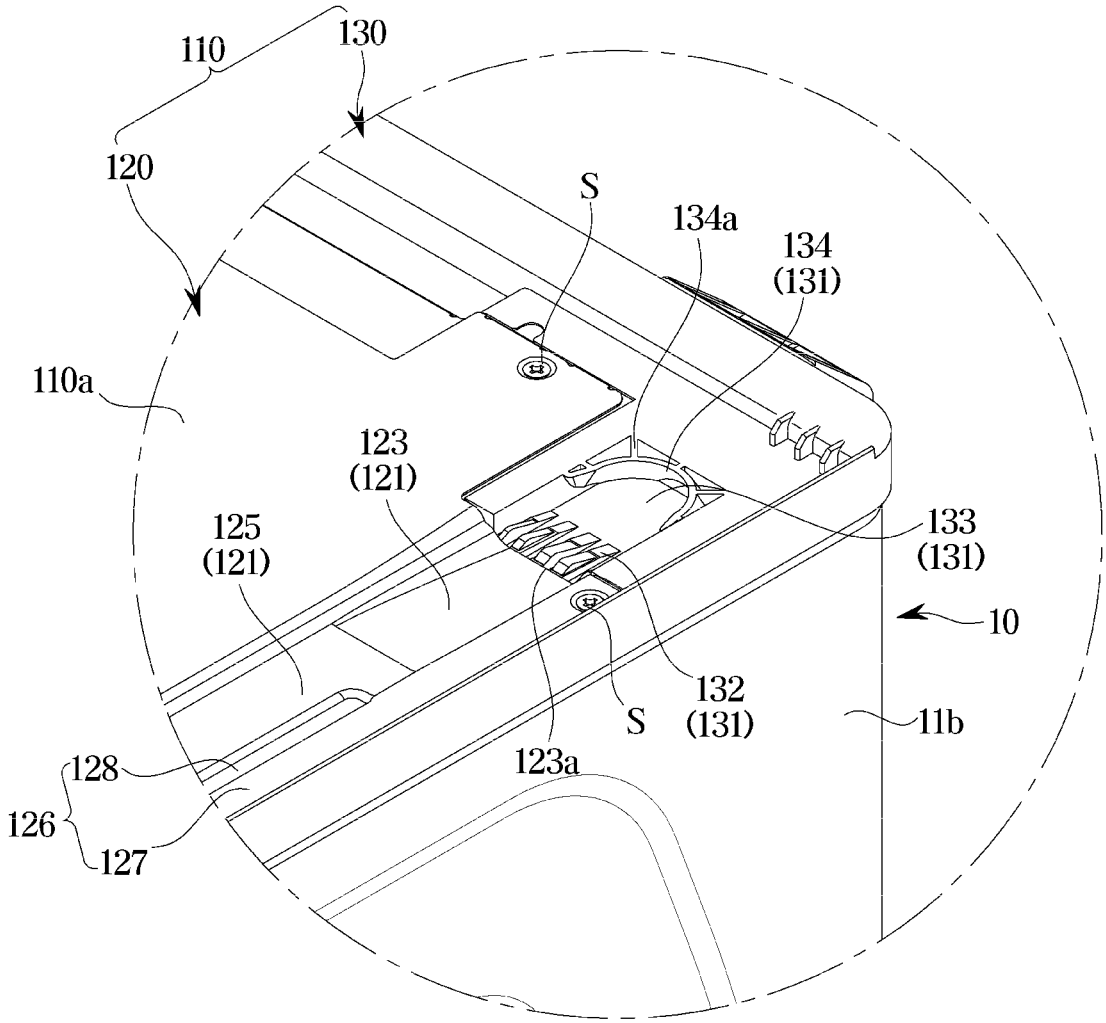
FIG. 11 is an enlarged view of part A in FIG. 2.
Figure 12:
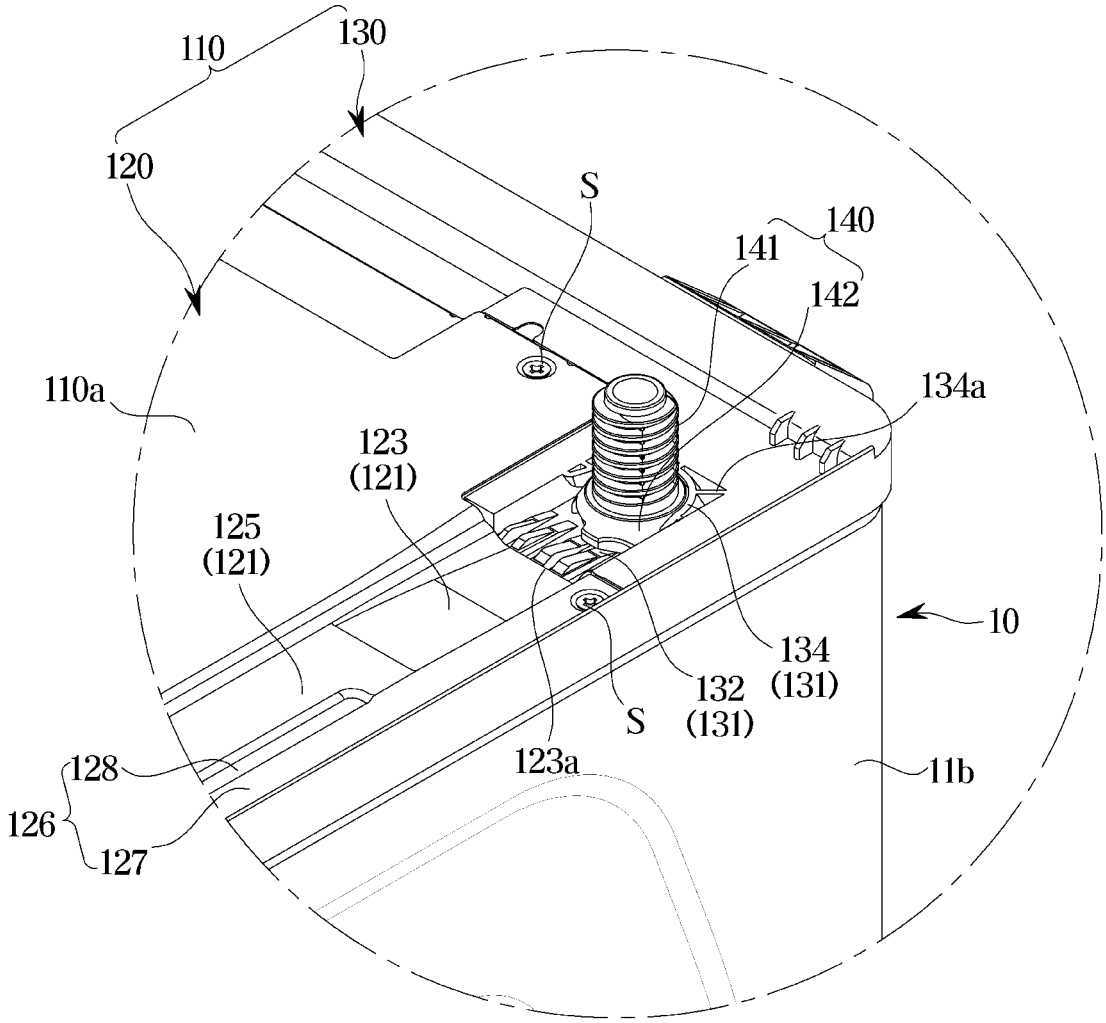
FIG. 12 illustrates a state in which a leg is seated in the first clothes treating apparatus illustrated in FIG. 11.
Figure 13:
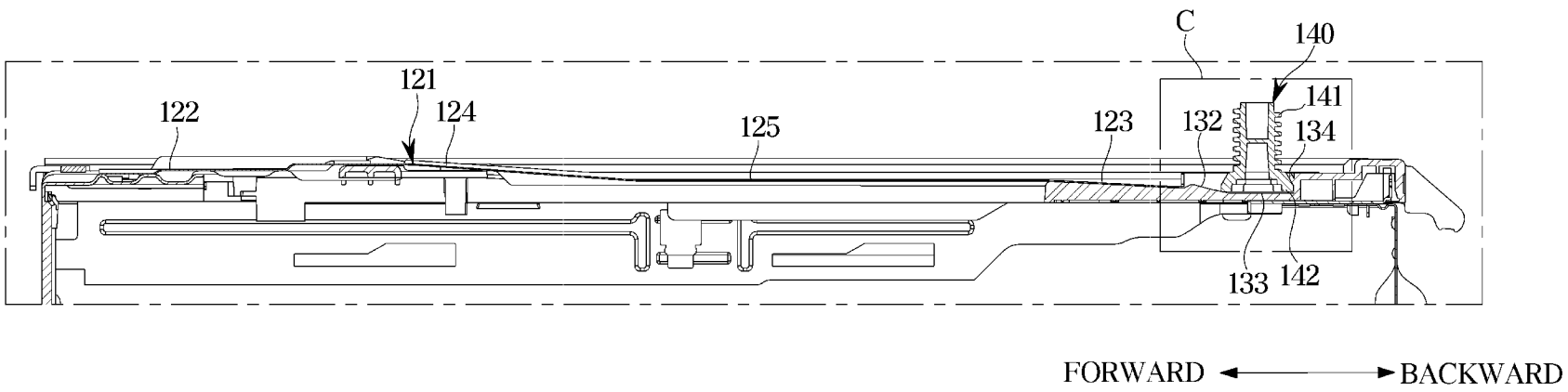
FIG. 13 illustrates a cross section taken along a line B-B' in FIG. 12.
Figure 14:
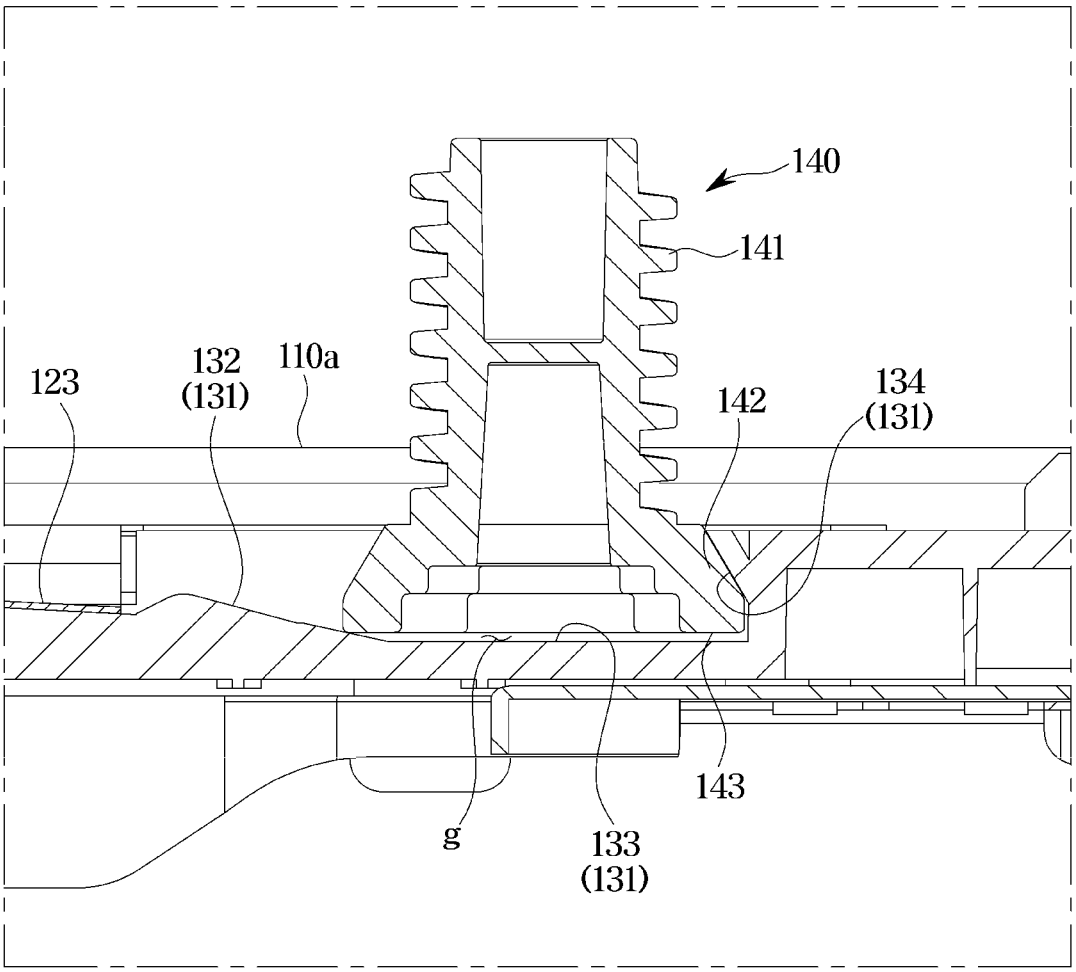
FIG. 14 is an enlarged view of part C in FIG. 13.

FIG. 10 is an exploded view of the upper surface of the first housing illustrated in FIG. 9. FIG. 11 is an enlarged view of part A in FIG. 2. FIG. 12 illustrates a state in which a leg is seated in the first clothes treating apparatus illustrated in FIG. 11. FIG. 13 illustrates a cross section taken along a line B-B' in FIG. 12. FIG. 14 is an enlarged view of part C in FIG. 13.

Referring to FIGS. 9 and 10, the first housing 11 of the first clothes treating apparatus 10 may include an upper surface 110. The upper surface 110 of the first housing 11 may refer to the upper surface 110 of the first clothes treating apparatus 10. Hereinafter, the upper surface 110 of the first housing 11 is referred to as the upper surface 110 for convenience.

Referring to FIG. 9, the upper surface 110 of the first housing 11 may include a sliding guide portion 121. A pair of the sliding guide portions 121 may be provided. The pair of sliding guide portions 121 may be provided adjacent to both ends of the upper surface 110, respectively. The sliding guide portion 121 may extend along a front-rear direction.

The upper surface 110 may include a supporting part 126 provided to support the second clothes treating apparatus 60. A pair of the supporting parts 126 may be provided. The supporting part 126 may be provided closer to an edge of the upper surface 110 than the sliding guide portion 121. The supporting part 126 include a first supporting part 127 provided adjacent to the edge of the upper surface 110 and a second supporting part 128 provided between the first supporting part 127 and the sliding guide portion 121.

The upper surface 110 may include a leg seating portion 131. A pair of the leg seating portions 131 may be provided. The pair of leg seating portions 131 may be provided at one ends of the pair of sliding guide portions 121, respectively. The pair of leg seating portions 131 may be provided adjacent to a rear end of the upper surface 110.

Referring to FIG. 10, the upper surface 110 may include a cover plate 120 and a plate supporting member 130.

The cover plate 120 may include the sliding guide portion 121. The cover plate 120 may include the supporting part 126. The cover plate 120 may be provided in a square plate shape. The cover plate 120 may form most of an upper surface of the first housing 11. The cover plate 120 may include a metal material. The cover plate 120 may be formed by press-processing a base of a metal material.

The plate supporting member 130 may include the leg seating portion 131. The plate supporting member 130 may be provided to support at least a portion of an edge of the cover plate 120. According to an embodiment, the plate supporting member 130 may support both side ends and a rear end of the cover plate 120. The plate supporting member 130 may include a connection beam 135 to reinforce a rigidity of the plate supporting member 130. The connection beam 135 may reinforce the rigidity of the plate supporting member 130 by connecting one side of the plate supporting member 130, which supports one side end of the cover plate 120, and the other side of the supporting member 130, which supports the other side end of the cover plate 120.

The plate supporting member 130 may include a third supporting part 136 and a fourth supporting part 137 which are provided to support the supporting part 126 below the supporting part 126. The third supporting part 136 may support the first supporting part 127. The fourth supporting part 137 may support the second supporting part 128.

The plate supporting member 130 may be molded by injection. The plate supporting member 130 including the leg seating portion 131 may implement a complex shape of the leg seating portion 131 by injection molding.

The cover plate 120 may include a plurality of fastening holes 120*a*, 120*b*, 120*c*, and 120*d*. The plate supporting member 130 may include a plurality of fastening holes 130*a*, 130*b*, 130*c*, and 130*d* corresponding to the plurality of fastening holes 120*a*, 120*b*, 120*c*, and 120*d* of the cover plate 120, respectively. As fastening members S (FIG. 11) are fastened to the plurality of fastening holes 120*a*, 120*b*, 120*c*, 120*d* of the cover plate 120 and the plurality of fastening holes 130*a*, 130*b*, 130*c*, 130*d* of the plate supporting member 130, which correspond to each other, respectively, the cover plate 120 and the plate supporting member 130 may be coupled.

Referring to FIGS. 11 and 12, the leg 140 provided on a lower surface of the second housing 61 may be seated on the leg seating portion 131 by sliding along the sliding guide portion 121. As the leg 140 is seated on the leg seating portion 131, the second clothes treating apparatus 60 may be coupled with the first clothes treating apparatus 10. The combining of the first clothes treating apparatus 10 and the second clothes treating apparatus 60 through the fastening members will be described later.

According to the present disclosure, the second clothes treating apparatus 60 may be coupled with the first clothes treating apparatus 10 from the front of the first clothes treating apparatus 10. More specifically, the second clothes treating apparatus 60 may be placed on the first clothes treating apparatus 10 from the front of the first clothes treating apparatus 10 and then slides backward, thereby being coupled with the first clothes treating apparatus 10. The clothes treating system 1 according to the present disclosure may include the sliding guide portion 121 and the leg seating portion 131 so that the second clothes treating apparatus 60 may be placed in an accurate assembly position on the first clothes treating apparatus 10.

The sliding guide portion 121 may be formed by recessing at least a portion of the upper surface 110 of the first housing 11 downward. More specifically, the sliding guide portion 121 may be formed by recessing at least a portion of the upper surface 110 downward with respect to one surface 110*a* of the upper surface 110. The sliding guide portion 121 may be formed by recessing at least a portion of the cover plate 120 downward.

The sliding guide portion 121 may extend from a first end 122*a* adjacent to a front end of the upper surface 110 to a second end 123*a* adjacent to the rear end of the upper surface 110. The sliding guide portion 121 may include a section in which a depth that is recessed downward from the upper surface 110 is gradually deepened toward the second end 123*a* from the first end 122*a*. In other words, between the first end 122*a* and the second end 123*a* of the sliding guide portion 121, a section in which a recessed depth is gradually deepened toward the rear may be provided.

According to an embodiment, the sliding guide portion 121 may include a first guide part 122 having the first end 122*a*. The first guide part 122 may form a front end of the sliding guide portion 121. The first guide part 122 may be provided to be flat. The first guide part 122 may be provided not to be inclined.

The sliding guide portion 121 may include a first inclined part 124 provided at a rear end of the first guide part 122. The first inclined part 124 may be provided to be inclined downward toward the rear. The first inclined part 124 may be provided such that a depth that is recessed downward with respect to the one surface 110*a* of the upper surface 110 is gradually deepened toward the rear.

The sliding guide portion 121 may include a second guide part 125 provided at a rear end of the first inclined part 124. The second guide part 125 may be provided to be flat. The second guide part 125 may be provided not to be inclined. The first inclined part 124 may be provided between the first guide part 122 and the second guide part 125.

The sliding guide portion 121 may include a second inclined part 123. The second inclined part 123 may include the second end 123*a*. The second end 123*a* may be provided at a rear end of the second inclined part 123. The second inclined part 123 may be provided to be inclined downward toward the rear. The second inclined part 123 may be provided such that a depth that is recessed downward with respect to the one surface 110*a* of the upper surface 110 is gradually deepened toward the rear.

However, the structure of the sliding guide portion 121 is not limited thereto. The sliding guide portion may be provided to be inclined from the first end to the second end, or may include one guide part and one inclined part. Alternatively, the sliding guide portion may include three or more guide parts and three or more inclined parts. That is, in the sliding guide portion, it is sufficient as long as a position of the second end is lower than that of the first end, and a structure between the first end and the second end may be changed.

Because the sliding guide portion 121 includes the first inclined part 124 and the second inclined part 123, the depths of which are recessed downward are deepened toward the rear, when a force is applied backward to the leg 140 located on the first guide part 122, the leg 140 may easily move backward by gravity. That is, the leg 140 may be more easily seated on the leg seating portion 131 along the sliding guide portion 121.

The leg seating portion 131 may be provided on a rear side of the sliding guide portion 121. The leg seating portion 131 may be provided on a rear side of the second end 123*a* so that the leg 140 slid from the first end 122*a* of the sliding guide portion 121 to the second end 123*a* is seated on the leg seating portion 131.

The leg seating portion 131 may include a protruding portion 132 connected to the second end 123*a* of the sliding guide portion 121. The protruding portion 132 may protrude above the second end 123*a*. A plurality of the protruding portions 132 may be provided. The plurality of protruding portions 132 may be arranged to be spaced laterally apart from each other. For example, the plurality of protruding portions 132 may include four of the protruding portions 132 arranged to be spaced laterally apart from each other. However, the present disclosure is not limited thereto. The number of the protruding portions 132 may be changed.

The protruding portion 132 may include a region protruding above the second end 123*a* and a region recessed below the second end 123*a*. The protruding region of the protruding portion 132 may be located at a front end of the protruding portion 132, and the recessed region of the protruding portion 132 may be located at a rear end of the protruding portion 132.

The sliding guide portion 121 may include a seating part 133 provided on a rear side of the protruding portion 132. The seating part 133 may be positioned below the second end 123*a*. The seating part 133 may be recessed below the second end 123*a*. The leg 140 may be accommodated in the seating part 133.

The sliding guide portion 121 may include a stopper 134 provided to support the leg 140 to prevent the leg 140 from moving to the rear of the seating part 133.

The stopper 134 may be positioned on a rear side of the seating part 133. The stopper 134 may form a groove having a shape corresponding to an outer surface of a flange part 142 of the leg 140. Through this, the leg 140 may come into surface contact with the stopper 134.

The protruding portion 132 may guide the leg 140 so that the leg 140 moved to the second end 123*a* of the sliding guide portion 121 is slightly moved upward and then seated on the seating part 133. The leg 140 may pass through the protruding portion 132 and then be fixedly seated on the seating part 133 by the protruding portion 132 and the stopper 134. As one side of the leg 140 is supported by the protruding portion 132 and the other side of the leg 140 is supported by the stopper 134, the leg 140 may be fixedly seated on the seating part 133. In a process in which the leg 140 is seated on the seating part 133 after passing through the protruding portion 132, a sound may be generated by contact between the leg 140 and the stopper 134. Through this sound, a user may confirm that the leg 140 is seated on the seating part 133. Convenience may be improved because the user may intuitively know whether the leg 140 is seated through sound.

Referring to FIG. 14, the leg 140 may include a fastening part 141 provided to be fastened to a leg hole 151 formed on a lower surface 150 of the second housing 61, which will be described later, and the flange part 142 provided at a lower end of the fastening part 141. The fastening part 141 may include a fastening structure such as a screw thread on an outer surface thereof. The flange part 142 may be provided at the lower end of the fastening part 141. The flange part 142 may be provided to have an area larger than an area of the fastening part 141. The flange part 142 may stably support the second clothes treating apparatus 60 by increasing a contact area with the ground. The flange part 142 may include a lower surface 143. The lower surface 143 of the flange part 142 may refer to the lower surface 143 of the leg 140.

As illustrated in FIG. 14, in the clothes treating system 1 according to the present disclosure, the lower surface 143 of the leg 140 seated on the leg seating portion 131 may not come into contact with the seating part 133. A predetermined gap g may be formed between the lower surface 143 of the leg 140 seated on the leg seating portion 131 and the seating part 133. In a case in which the lower surface 143 of the leg 140 comes into contact with the seating part 133 when the leg 140 is seated on the leg seating portion 131, a load of the second clothes treating apparatus 60 transmitted through the leg 140 may be concentrated on the seating part 133.

When the load of the second clothes treating apparatus 60 is concentrated on the seating part 133, the seating part 133 may be damaged. According to the present disclosure, in order to prevent load concentration on the seating part 133 and distribute the load, the predetermined gap g may be formed between the lower surface 143 of the leg 140 and the seating part 133.

According to the present disclosure, the lower surface 143 of the leg 140 seated on the leg seating portion 131 may be located below the upper surface 110 of the first clothes treating apparatus 10. As illustrated in FIG. 14, the lower surface 143 of the leg 140 may be located below the one surface 110*a* of the upper surface 110. Through this, a height of the clothes treating system 1 according to the present disclosure may be lowered, and a height of the object inlet 62 of the second clothes treating apparatus 60 may be lowered. In the case of relatively short women, the use of the clothes treating system 1 may be inconvenient because the object inlet 62 of the second clothes treating apparatus 60 is high. Conventionally, after a separate structure is coupled on the first clothes treating apparatus, the second clothes treating apparatus is positioned and coupled on and to the separate structure. That is, because a separate structure is disposed between the first clothes treating apparatus and the second clothes treating apparatus, not only does the overall height of the clothes treating system increase, but also the height of the object inlet of the second clothes treating apparatus increases. In the clothes treating system 1 according to the present disclosure, because not only a separate structure for combining the first clothes treating apparatus 10 and the second clothes treating apparatus 60 is not provided between the first clothes treating apparatus 10 and the second clothes treating apparatus 60, but also the lower surface 143 of the leg 140 provided on the lower surface of the second clothes treating apparatus 60 is located below the upper surface 110 of the first clothes treating apparatus 10, the overall height of clothes treating system 1 may be lowered. In addition, the height of the object inlet 62 of the second clothes treating apparatus 60 may be lowered. Therefore, user convenience may be improved, space utilization may be improved because the height of the clothes treating system is lowered, and the number of parts and the number of processes may be reduced and the combination may be facilitated because the first clothes treating apparatus and the second clothes treating apparatus do not require a separate structure when coupled.

Figure 15:
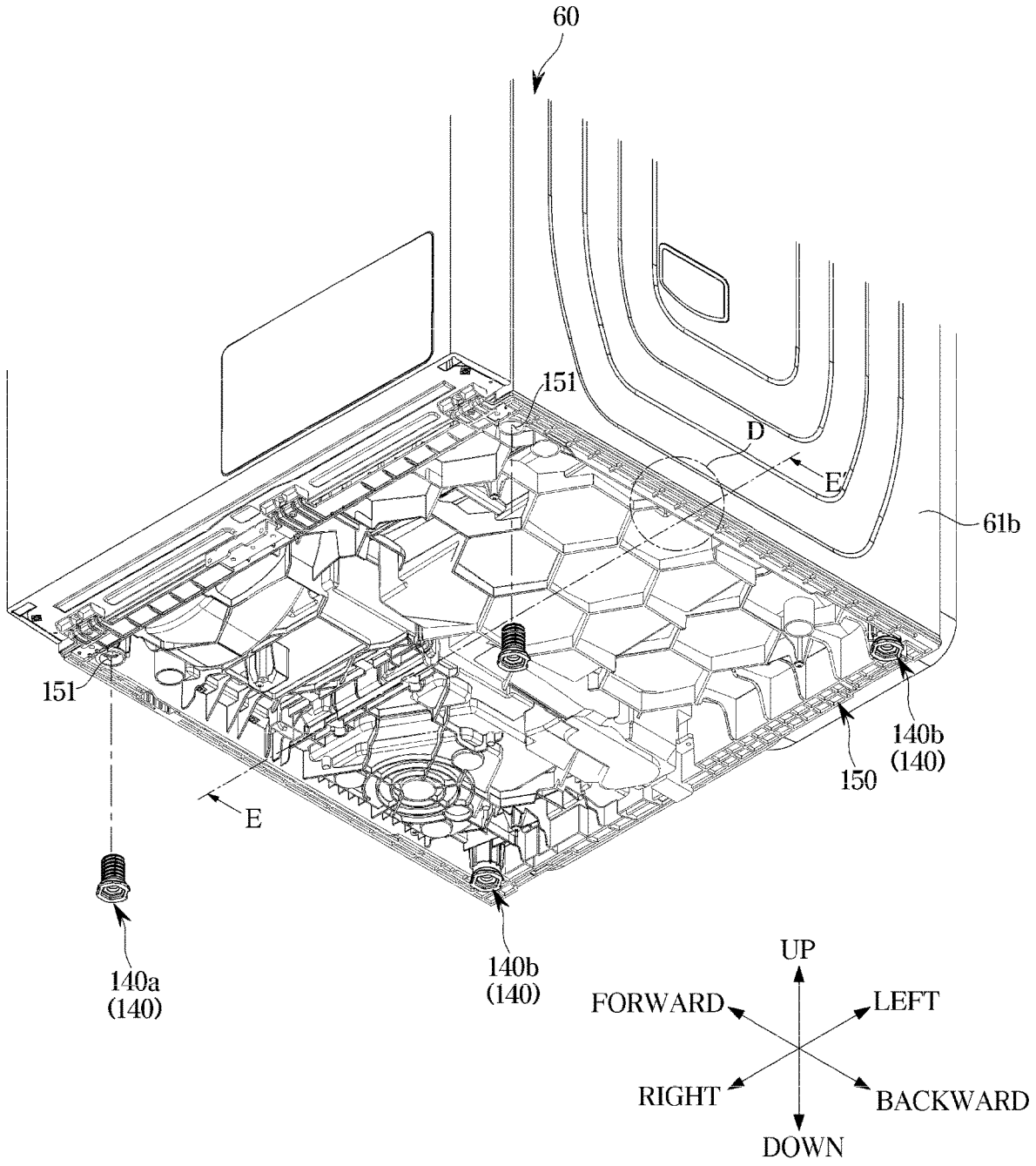
FIG. 15 illustrates a bottom surface of the second clothes treating apparatus of the clothes treating system according to an embodiment.
Figure 16:
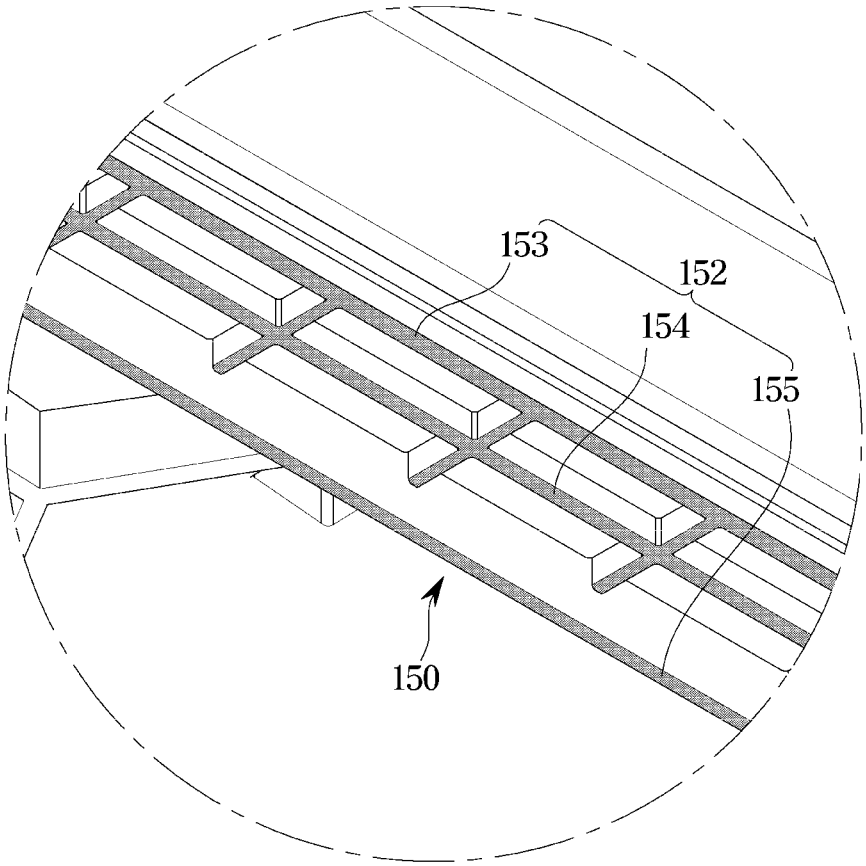
FIG. 16 is an enlarged view of part D in FIG. 15.
Figure 17:
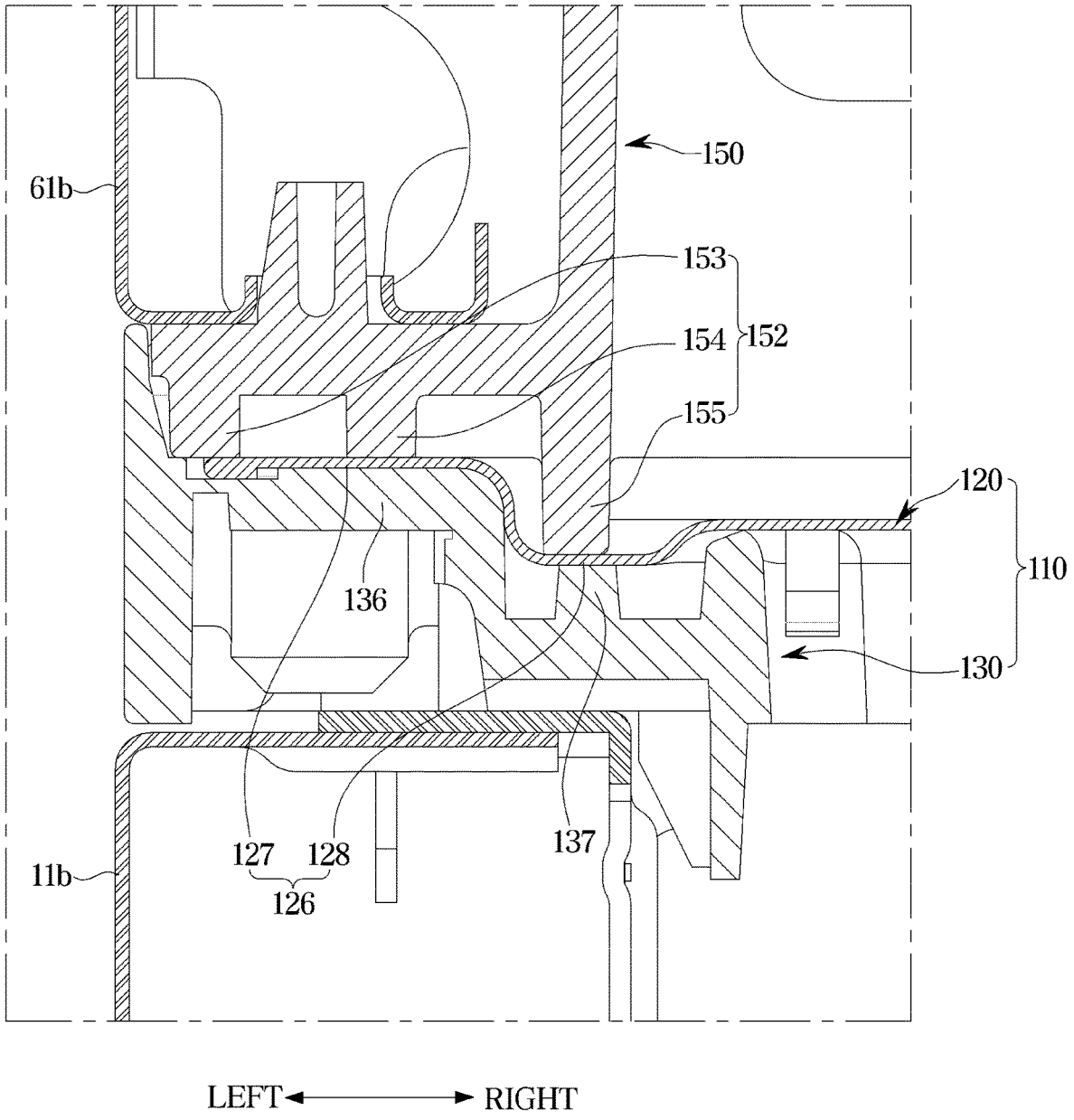
FIG. 17 illustrates a cross section taken along a line E-E' of FIG. 15 when the first clothes treating apparatus and the second clothes treating apparatus are coupled in the clothes treating system according to an embodiment.

FIG. 15 illustrates a bottom surface of the second clothes treating apparatus of the clothes treating system according to an embodiment. FIG. 16 is an enlarged view of part D in FIG. 15. FIG. 17 illustrates a cross section taken along a line E-E' of FIG. 15 when the first clothes treating apparatus and the second clothes treating apparatus are coupled in the clothes treating system according to an embodiment.

Referring to FIG. 15, the second clothes treating apparatus 60 may include the lower surface 150 of the second housing 61 forming the lower surface thereof.

The lower surface 150 of the second housing 61 may refer to the lower surface of the second clothes treating apparatus 60. Hereinafter, the lower surface 150 of the second housing 61 is referred to as the lower surface 150 for convenience.

The lower surface 150 may include the leg hole 151 provided such that the leg 140 is coupled thereto. The leg 140 may be directly coupled to the leg hole 151 through the fastening part 141 without a separate fastening member.

Hereinafter, the leg 140 provided on a front side of the lower surface 150 is referred to as a first leg 140*a*. Also, the leg 140 provided on a rear side of the lower surface 150 is referred to as a second leg 140*b*. The first leg 140*a* may be configured so that, when the second clothes treating apparatus 60 is not coupled to the first clothes treating apparatus 10, the second clothes treating apparatus 60 stands on its own.

The leg 140 may be detachably coupled to the lower surface 150. As described above, the leg 140 may be coupled to the leg hole 151 without a separate fastening member and may be separated from the leg hole 151 without a separate fastening member.

Although FIG. 15 illustrates a state in which the first leg 140*a* is separated from the leg hole 151, the second leg 140*b* may also be separated from the leg hole 151.

Referring to FIG. 16, the lower surface 150 may include a contact part 152 provided to come into contact with the upper surface 110. More specifically, the lower surface 150 may include a first contact part 153 adjacent to an edge of the lower surface 150, and a second contact part 154 spaced further from the edge of the lower surface 150 than the first contact part 153. Also, the lower surface 150 may include a third contact part 155 spaced further from the edge of the lower surface 150 than the first contact part 153 and the second contact part 154 and protruding downward more than the first contact part 153 and the second contact part 154.

The contact part 152 may be formed along at least a portion of the edge of the lower surface 150. The contact part 152 may refer to a rib formed along at least a portion of the edge of the lower surface 150. A predetermined groove may be formed between the first contact part 153 and the second contact part 154. A predetermined groove may be formed between the second contact part 154 and the third contact part 155. Also, the lower surface 150 may include an extension rib extending from the first contact part 153 toward the third contact part 155.

Referring to FIG. 17, when the second clothes treating apparatus 60 is coupled on the first clothes treating apparatus 10, a load of the second clothes treating apparatus 60 may be transferred to a side surface 11*b* of the first housing 11.

Through this, the transfer of the load to a central portion of the upper surface 11 of the first housing 11, which has a relatively weak load-bearing force, may be reduced, and the transfer of the load to the side surface 11*b* of the first housing 11, which has a relatively strong load-bearing force, may be increased. Because the side surface 11*b* of the first housing 11 extends in a vertical direction, it has an excellent ability to withstand the load of the second clothes treating apparatus 60 applied in the direction of gravity.

According to the present disclosure, the load of the second clothes treating apparatus 60 may be transferred to the side surface 11*b* of the first housing 11 through the contact part 152.

As illustrated in FIG. 17, the third supporting part 136 may support the first supporting part 127 by coming into contact with the first supporting part 127. The fourth supporting part 137 may support the second supporting part 128 by coming into contact with the second supporting part 128. The first supporting part 127 may support the first contact part 153 and the second contact part 154 by coming into contact with the first contact part 153 and the second contact part 154. The second supporting part 128 may support the third contact part 155 by coming into contact with the third contact part 155. The load of the second clothes treating apparatus 60 transferred to the first to fourth supporting parts 127, 128, 136, and 137 may be transferred to the side surface 11*b* of the first housing 11 located below the first to fourth supporting parts 127, 128, 136, and 137. Although not specifically illustrated in the drawings, a central portion of the lower surface 150 of the second housing 61 and the central portion of the upper surface 110 of the first housing 11 may be provided so as not to come into contact with each other so that the load of the second clothes treating apparatus 60 is not transferred.

Figure 18:
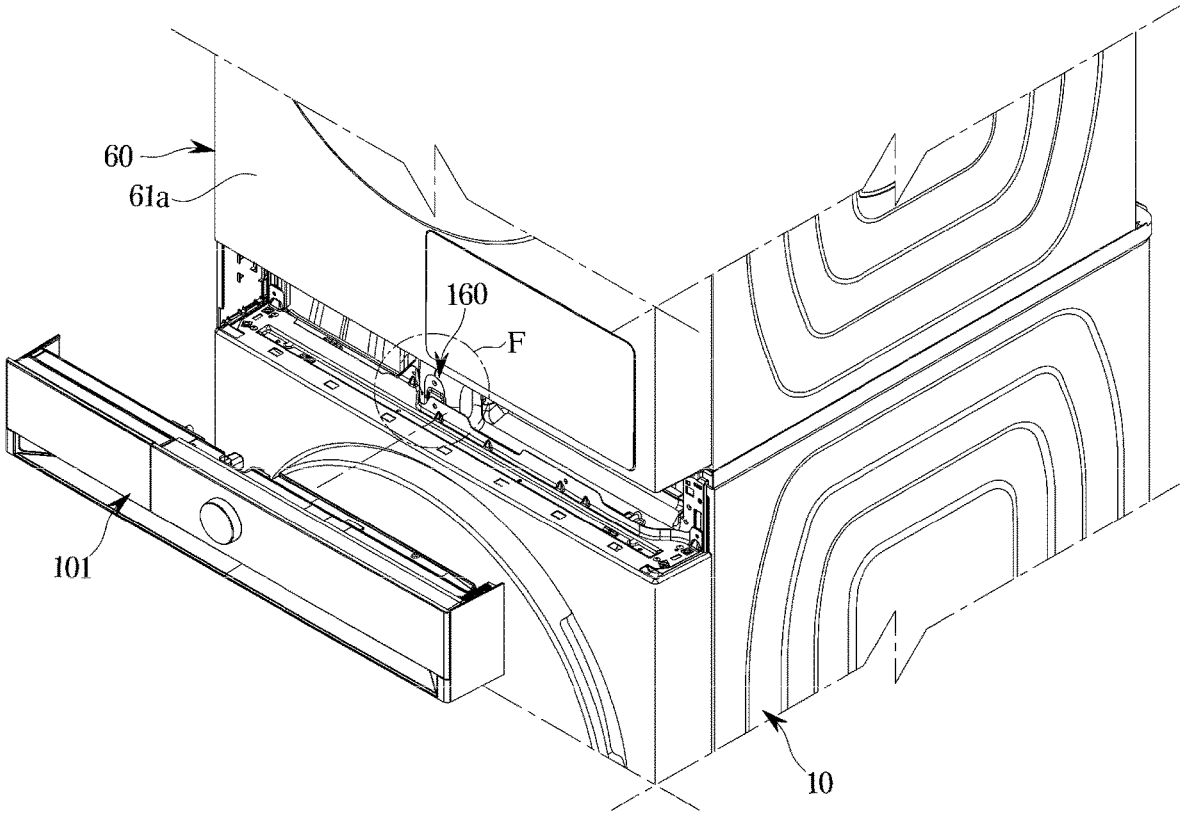
FIG. 18 illustrates a state in which a control panel is separated from the clothes treating system according to an embodiment.
Figure 19:
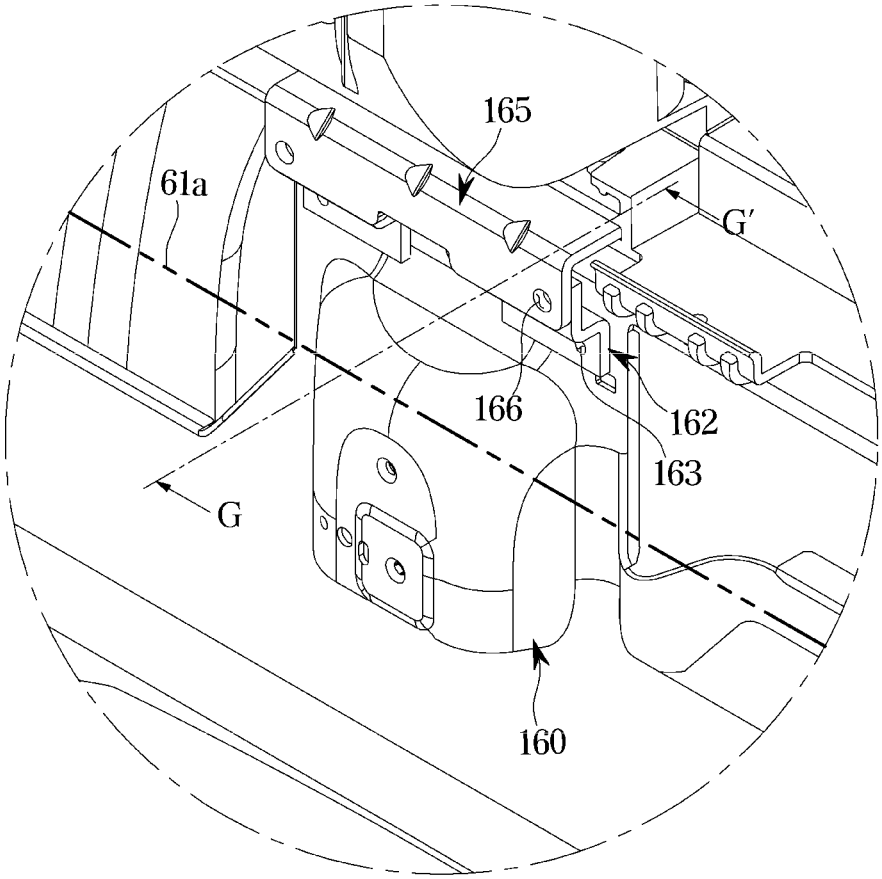
FIG. 19 is an enlarged view of part F in FIG. 18.
Figure 20:
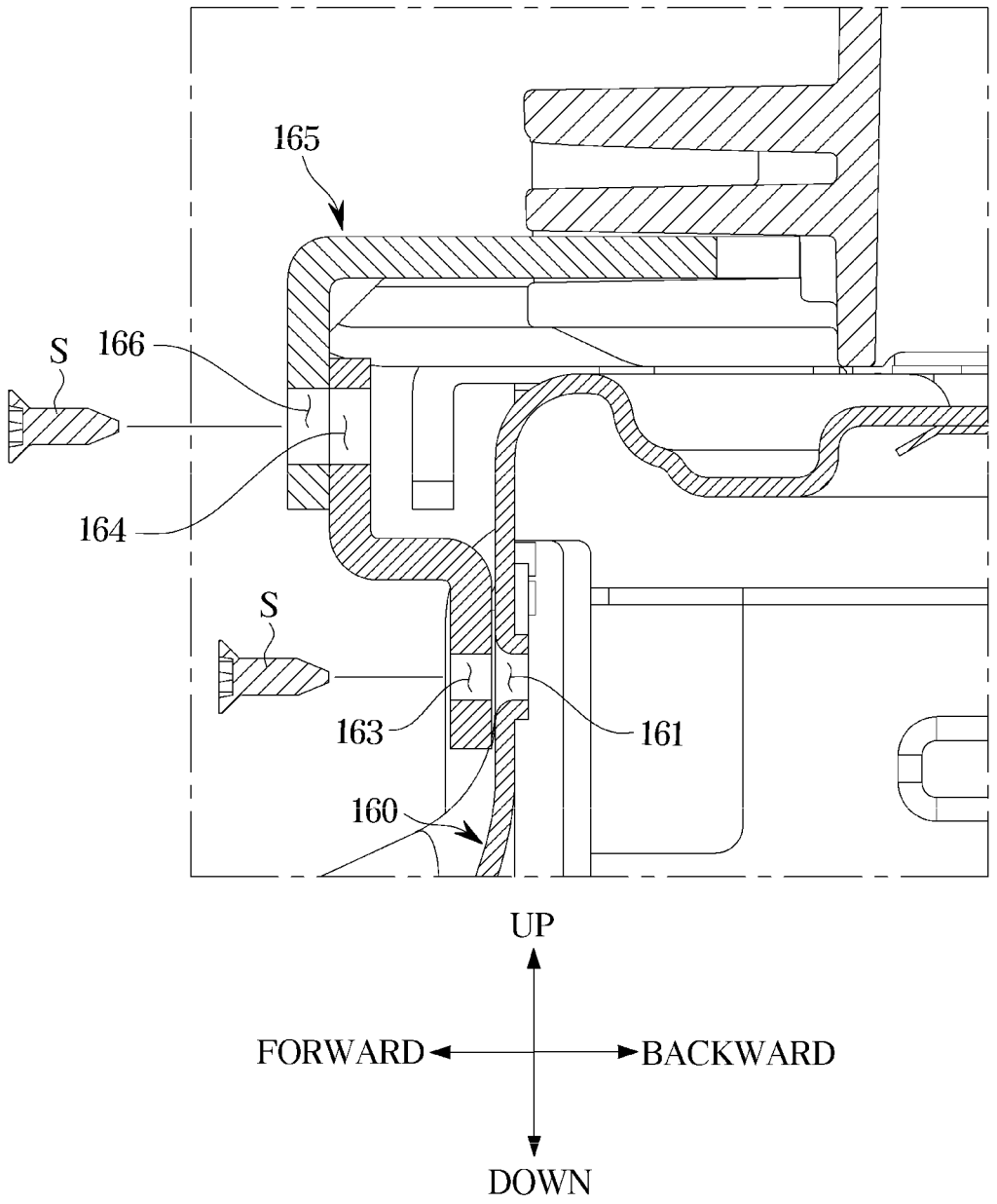
FIG. 20 illustrates a cross section taken along a line G-G' in FIG. 19.

FIG. 18 illustrates a state in which a control panel is separated from the clothes treating system according to an embodiment. FIG. 19 is an enlarged view of part F in FIG. 18. FIG. 20 illustrates a cross section taken along a line G-G' in FIG. 19.

Referring to FIG. 18, when the control panel 101 is separated from the clothes treating system according to an embodiment, a front bracket 160 of the first clothes treating apparatus 10 may be exposed to the front of the first clothes treating apparatus 10.

Referring to FIG. 19, a first bracket 162 may be coupled to the front bracket 160 of the first clothes treating apparatus 10. A second bracket 165 provided in the second clothes treating apparatus 10 may be coupled to the first bracket 162.

When the leg 140 is fixedly seated on the leg seating portion 131, the second clothes treating apparatus 60 may be primarily coupled to the first clothes treating apparatus 10. In other words, when a force is applied forward to the second clothes treating apparatus 60 when the leg 140 is fixedly seated on the leg seating portion 131, the second clothes treating apparatus 60 may move forward and be separated from the first clothes treating apparatus 10. Accordingly, a secondary combination is required so that the second clothes treating apparatus 60 is not separated from the first clothes treating apparatus 10 even when a force is applied to the second clothes treating apparatus 60.

Referring to FIG. 20, as the fastening member S is fastened to a first hole 161 of the front bracket 160 and a second hole 163 of the first bracket 162 corresponding to the first hole 161, the first bracket 162 may be coupled to the front bracket 160. However, the present disclosure is not limited thereto. The first bracket 162 and the front bracket 160 may be integrally formed. That is, the first bracket 162 and the front bracket 160 are formed as one body, so that separate coupling may not be required.

As a third hole 164 of the first bracket 162 and a fourth hole 166 of the second bracket 165 are positioned correspondingly and then the fastening member S is fastened to the third hole 164 and the fourth hole 166, the first bracket 162 and the second bracket 165 may be coupled. When the first bracket 162 and the second bracket 165 are coupled, the first clothes treating apparatus 10 and the second clothes treating apparatus 60 may be coupled so as not to be separated. That is, even when a force is applied to the second clothes treating apparatus 60 forward, the second clothes treating apparatus 60 may not be separated from the first clothes treating apparatus 10.

According to the present disclosure, the first bracket 162 may be positioned at the rear of the second bracket 165. A coupling portion at which the third hole 164 of the first bracket 162 is formed extends upward, and a coupling portion at which the fourth hole 166 of the second bracket 165 is formed extends downward. Through this structure, even when the second clothes treating apparatus 60 moves from the front to the rear of the first clothes treating apparatus 10, the first bracket 162 and the second bracket 165 may not interfere with each other.

When the first bracket is located in front of the second bracket, the first bracket and the second bracket may come into contact with each other and cause interference in a process of moving the second clothes treating apparatus backward. In order to avoid the above interference, it is required to lift the second clothes treating apparatus upward, and because the second clothes treating apparatus has a considerable weight, the burden of an operator may be increased.

According to the present disclosure, interference between the first bracket 162 and the second bracket 165 may be prevented, so that the installability of the first clothes treating apparatus 10 and the second clothes treating apparatus 60 may be improved.

Figure 21:
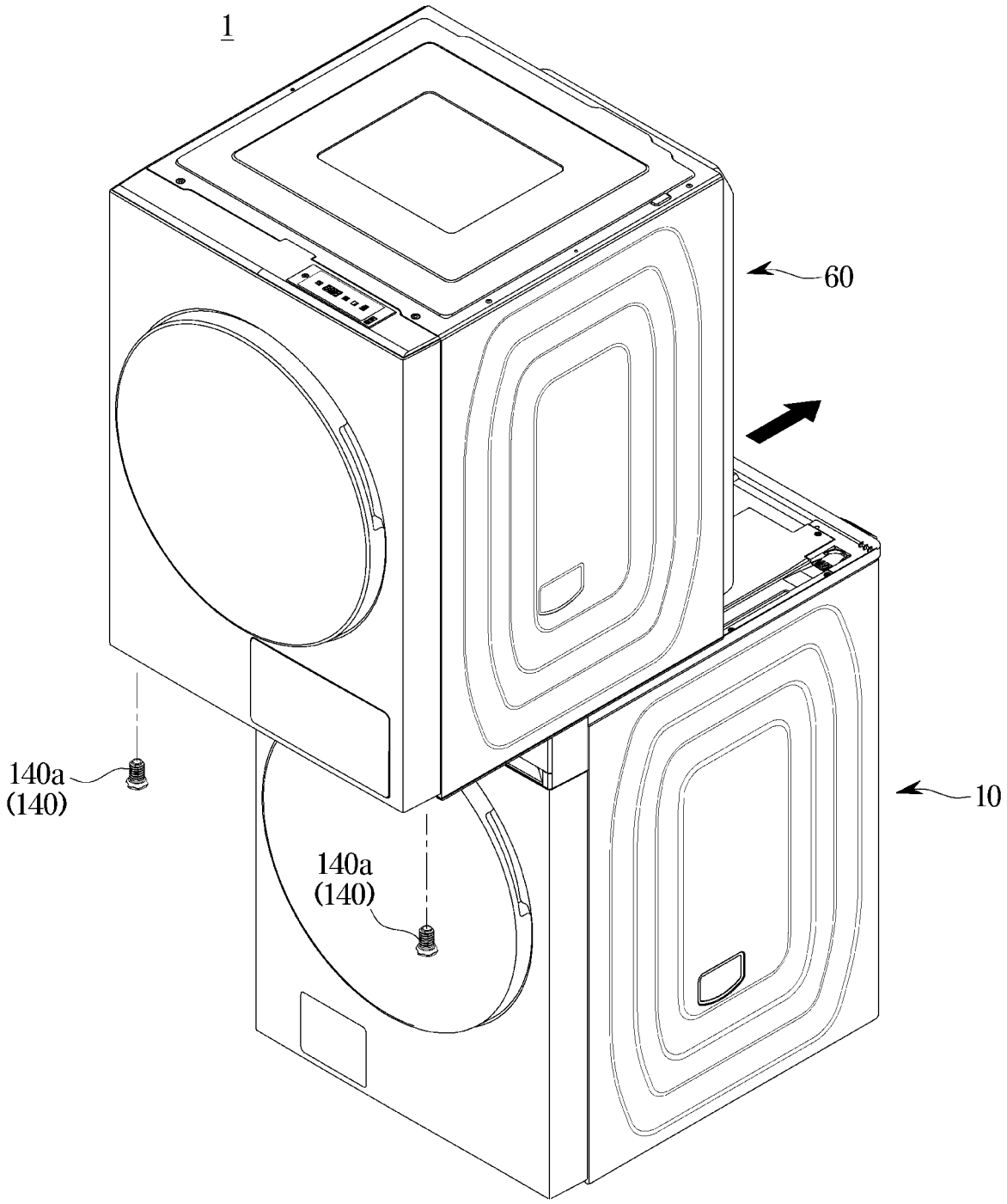
FIG. 21 illustrates a process in which the first clothes treating apparatus and the second clothes treating apparatus are coupled in the clothes treating system according to an embodiment.

FIG. 21 illustrates a process in which the first clothes treating apparatus and the second clothes treating apparatus are coupled in the clothes treating system according to an embodiment.

Referring to FIG. 21, the second clothes treating apparatus 60 may be coupled with the first clothes treating apparatus 10 from the front of the first clothes treating apparatus 10.

When the second clothes treating apparatus 60 is placed on the first clothes treating apparatus 10, the second clothes treating apparatus 60 may be located to protrude to the front of the first clothes treating apparatus 10. Also, as illustrated in FIG. 21, the first leg 140*a* coupled to the front side of the lower surface of the second clothes treating apparatus 60 may be separated. According to the present disclosure, when the second clothes treating apparatus 60 is coupled above the first clothes treating apparatus 10, the first leg 140*a* may be separated. Therefore, when the first clothes treating apparatus 10 and the second clothes treating apparatus 60 are coupled, only the second leg 140*b* may be coupled to the second clothes treating apparatus 60. Because components such as the detergent box are disposed on a front side of the upper surface 110 of the first clothes treating apparatus 10, it is difficult to lower the height thereof. In the clothes treating system 1 according to the present disclosure, when the second clothes treating apparatus 60 is coupled with the first clothes treating apparatus 10, the first leg 140*a* provided on the front side of the lower surface 150 of the second clothes treating apparatus 60 is separated, thereby lowering the overall height.

After the first leg 140*a* is separated, the second leg 140*b* may be fixedly seated on the leg seating portion 131 by sliding the second clothes treating apparatus 60 located on the first clothes treating apparatus 10 backward.

After the second leg 140*b* is fixedly seated on the leg seating portion 131, as the control panel 101 is separated and the first bracket 162 and the second bracket 165 are coupled, the combination of the first clothes treating apparatus 10 and the second clothes treating apparatus 60 may be completed.

The clothes treating system 1 according to an embodiment includes the first clothes treating apparatus 10 including the first housing 11, and the second clothes treating apparatus 60 including the second housing 61 and provided to be coupled above the first clothes treating apparatus. The first housing includes the sliding guide portion 121 provided on the upper surface 110 of the first housing and the leg seating portion 131 provided at one end of the sliding guide portion. The second housing includes the leg 140 provided to be seated on the leg seating portion by sliding along the sliding guide portion. The leg is provided on the rear side of the lower surface 150 of the second housing. The lower surface 143 of the leg seated on the leg seating portion is located below the upper surface of the first housing.

The sliding guide portion may be formed by recessing at least a portion of the upper surface of the first housing downward.

The sliding guide portion may extend from the first end 122*a* adjacent to the front end of the upper surface of the first housing to the second end 123*a* adjacent to the rear end of the upper surface of the first housing.

The sliding guide portion may include the regions 123 and 124 in which the depths that are recessed downward from the upper surface of the first housing are gradually deepened toward the second end from the first end.

The leg seating portion may be provided on the rear side of the second end so that the leg slid from the first end to the second end of the sliding guide portion is seated on the leg seating portion.

The leg seating portion may include the protruding portion 132 connected to the second end of the sliding guide portion and protruding upward more than the second end, the seating part 133 provided on the rear side of the protruding portion and on which the leg is seated, and the stopper 134 provided to support the leg to prevent the leg from moving to the rear of the seating part.

The leg may be fixedly seated on the seating part as one side of the leg is supported by the protruding portion and the other side of the leg is supported by the stopper.

The second housing may include the contact part 152 provided along at least a portion of the edge of the lower surface of the second housing to come into contact with the upper surface of the first housing.

The first housing may include the supporting part 126 provided along at least a portion of the edge of the upper surface of the first housing to support the contact part of the second housing.

The contact part may include the first contact part 153 adjacent to the edge of the lower surface of the second housing, the second contact part 154 spaced further from the edge of the lower surface than the first contact part, and the third contact part 155 spaced further from the edge of the lower surface than the second contact part and protruding downward more than the first contact part and the second contact part.

The supporting part may include the first supporting part 127 adjacent to the edge of the upper surface of the first housing and provided to support the first contact part and the second contact part, and the second supporting part 128 spaced further from the edge of the upper surface than the first supporting part and recessed downward more than the first supporting part to support the third contact part.

The side surface 11*b* of the first housing may be disposed below the supporting part to support the load of the second clothes treating apparatus transferred through the contact part and the supporting part.

The upper surface of the first housing may include the cover plate 120 including the sliding guide portion, and the plate supporting member 130 including the leg seating portion and provided to support at least a portion of the edge of the cover plate.

The second clothes treating apparatus may be coupled with the first clothes treating apparatus by sliding backward after being located on the first clothes treating apparatus from the front of the first clothes treating apparatus.

The second clothes treating apparatus may include the first leg 140*a* provided on the front side of the lower surface of the second housing so that the second clothes treating apparatus may stand on its own, and the second leg 140*b* provided on the rear side of the lower surface of the second housing.

When the second clothes treating apparatus is coupled with the first clothes treating apparatus, the first leg may be separated from the lower surface of the second housing.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

What is claimed is:

1. A clothes treating system comprising:

a first clothes treating apparatus including a first housing, wherein an upper surface of the first housing includes a guide part, which is horizontal and flat, and a portion of the upper surface of the first housing that is adjacent to, and to a rear of, the guide part is recessed downward from the upper surface of the first housing toward a rear end of the upper surface of the first housing such that the guide part and the portion of the upper surface of the first housing together form a sliding guide portion on the upper surface of the first housing, and the first clothes treating apparatus includes a leg seating portion at an end of the sliding guide portion, wherein the leg seating portion includes a protruding portion adjacent to the sliding guide portion and protruding upward more than the sliding guide portion; and a second clothes treating apparatus including a second housing, and the second housing including a leg on a rear side of a lower surface of the second housing, wherein the first clothes treating apparatus and the second clothes treating apparatus are configured so that the leg is slidable along the sliding guide portion from a front end of the guide part to a rear end of the portion of the upper surface of the first housing to seat the leg on the leg seating portion with a lower surface of the leg being below the upper surface of the first housing, to couple the second clothes treating apparatus to the first clothes treating apparatus with the second clothes treating apparatus above the first clothes treating apparatus.

2. The clothes treating system according to claim 1, wherein the sliding guide portion extends from a first end of the sliding guide portion that is adjacent to a front end of the upper surface of the first housing to a second end of the sliding guide portion that is adjacent to the rear end of the upper surface of the first housing.

3. The clothes treating system according to claim 2, wherein the portion of the upper surface of the first housing includes a plurality of regions having depths that are recessed downward from the upper surface of the first housing and gradually deepen at different slopes toward the second end of the sliding guide portion.

4. The clothes treating system according to claim 2, wherein the leg seating portion is on a rear side of the second end of the sliding guide portion, and the first clothes treating apparatus and the second clothes treating apparatus are configured so that the leg is slidable from the first end of the sliding guide portion to the second end of the sliding guide portion to be seated on the leg seating portion.

5. The clothes treating system according to claim 2, wherein the protruding portion is connected to the second end of the sliding guide portion, and the leg seating portion includes:

a seating part on a rear side of the protruding portion and on which the leg becomes seated when the leg is seated on the leg seating portion, and a stopper configured to prevent the leg seated on the seating part from moving to a rear of the seating part.

6. The clothes treating system according to claim 5, wherein the leg seating portion is configured so that, when the leg is seated on the leg seating portion, the leg is fixedly seated on the seating part as one side of the leg is supported by the protruding portion and an other side of the leg is supported by the stopper.

7. The clothes treating system according to claim 1, wherein the second housing includes a contact part along at least a portion of an edge of the lower surface of the second housing and configured to come into contact with the upper surface of the first housing when the second clothes treating apparatus is coupled to the first clothes treating apparatus, and the first housing includes a supporting part along at least a portion of an edge of the upper surface of the first housing and configured to support the contact part of the second housing when the second clothes treating apparatus is coupled to the first clothes treating apparatus.

8. The clothes treating system according to claim 7, wherein the contact part includes:

a first contact part adjacent to the edge of the lower surface of the second housing, a second contact part spaced further from the edge of the lower surface than the first contact part, and a third contact part spaced further from the edge of the lower surface than the second contact part and protruding downward more than the first contact part and the second contact part.

9. The clothes treating system according to claim 8, wherein the supporting part includes:

a first supporting part adjacent to the edge of the upper surface of the first housing and configured to support the first contact part and the second contact part when the second clothes treating apparatus is coupled to the first clothes treating apparatus, and a second supporting part spaced further from the edge of the upper surface than the first supporting part, recessed downward more than the first supporting part, and configured to support the third contact part when the second clothes treating apparatus is coupled to the first clothes treating apparatus.

10. The clothes treating system according to claim 7, wherein a side surface of the first housing is disposed below the supporting part to support a load of the second clothes treating apparatus transferred through the contact part and the supporting part when the second clothes treating apparatus is coupled to the first clothes treating apparatus.

11. The clothes treating system according to claim 1, wherein the upper surface of the first housing includes:

a cover plate that includes the sliding guide portion, and a plate supporting member that includes the leg seating portion and is configured to support at least a portion of an edge of the cover plate.

12. The clothes treating system according to claim 1, wherein the first clothes treating apparatus and the second clothes treating apparatus are configured so that the second clothes treating apparatus is couplable to the first clothes treating apparatus by being positioned on the first clothes treating apparatus and then sliding backward from a front of the first clothes treating apparatus.

13. The clothes treating system according to claim 1, wherein the second clothes treating apparatus includes an additional leg on a front side of the lower surface of the second housing and configured so that, when the second clothes treating apparatus is coupled to the first clothes treating apparatus, the second clothes treating apparatus stands on its own.

14. The clothes treating system according to claim 13, wherein when the second clothes treating apparatus is coupled to the first clothes treating apparatus, the additional leg is separated from the lower surface of the second housing.

15. A clothes treating system comprising:

a first clothes treating apparatus including a first housing, wherein at least a portion of an upper surface of the first housing is recessed downward from the upper surface of the first housing toward a rear end of the upper surface of the first housing to form a sliding guide portion on the upper surface of the first housing, and the first clothes treating apparatus includes a leg seating portion at an end of the sliding guide portion; and a second clothes treating apparatus including a second housing, and the second housing including a leg on a rear side of a lower surface of the second housing, wherein the first clothes treating apparatus and the second clothes treating apparatus are configured so that the leg is slidable along the sliding guide portion to seat the leg on the leg seating portion with a lower surface of the leg being below the upper surface of the first housing, to couple the second clothes treating apparatus to the first clothes treating apparatus with the second clothes treating apparatus above the first clothes treating apparatus, the sliding guide portion extends from a first end of the sliding guide portion that is adjacent to a front end of the upper surface of the first housing to a second end of the sliding guide portion that is adjacent to the rear end of the upper surface of the first housing, and the leg seating portion includes:

a protruding portion connected to the second end of the sliding guide portion and protruding upward more than the second end of the sliding guide portion, a seating part on a rear side of the protruding portion and on which the leg becomes seated when the leg is seated on the leg seating portion, and a stopper configured to prevent the leg seated on the seating part from moving to a rear of the seating part.

16. The clothes treating system according to claim 15, wherein the leg seating portion is configured so that, when the leg is seated on the leg seating portion, the leg is fixedly seated on the seating part as one side of the leg is supported by the protruding portion and an other side of the leg is supported by the stopper.

17. A clothes treating system comprising:

a first clothes treating apparatus including a first housing, wherein at least a portion of an upper surface of the first housing is recessed downward from the upper surface of the first housing toward a rear end of the upper surface of the first housing to form a sliding guide portion on the upper surface of the first housing, and the first clothes treating apparatus includes a leg seating portion at an end of the sliding guide portion; and a second clothes treating apparatus including a second housing, and the second housing including a leg on a rear side of a lower surface of the second housing, wherein the first clothes treating apparatus and the second clothes treating apparatus are configured so that the leg is slidable along the sliding guide portion to seat the leg on the leg seating portion with a lower surface of the leg being below the upper surface of the first housing, to couple the second clothes treating apparatus to the first clothes treating apparatus with the second clothes treating apparatus above the first clothes treating apparatus, the second housing includes a contact part along at least a portion of an edge of the lower surface of the second housing and configured to come into contact with the upper surface of the first housing when the second clothes treating apparatus is coupled to the first clothes treating apparatus, the first housing includes a supporting part along at least a portion of an edge of the upper surface of the first housing and configured to support the contact part of the second housing when the second clothes treating apparatus is coupled to the first clothes treating apparatus, and the contact part includes:

a first contact part adjacent to the edge of the lower surface of the second housing, a second contact part spaced further from the edge of the lower surface than the first contact part, and a third contact part spaced further from the edge of the lower surface than the second contact part and protruding downward more than the first contact part and the second contact part.

18. The clothes treating system according to claim 17, wherein the supporting part includes:

a first supporting part adjacent to the edge of the upper surface of the first housing and configured to support the first contact part and the second contact part when the second clothes treating apparatus is coupled to the first clothes treating apparatus, and a second supporting part spaced further from the edge of the upper surface than the first supporting part, recessed downward more than the first supporting part, and configured to support the third contact part when the second clothes treating apparatus is coupled to the first clothes treating apparatus.

* * * * *